US011261701B2

(12) United States Patent
Kshyk et al.

(10) Patent No.: US 11,261,701 B2
(45) Date of Patent: Mar. 1, 2022

(54) SHIFTING TOOL AND ASSOCIATED METHODS FOR OPERATING DOWNHOLE VALVES

(71) Applicant: WEATHERFORD TECHNOLOGY HOLDINGS, LLC, Houston, TX (US)

(72) Inventors: Corey M. Kshyk, Edmonton (CA); Todd A. Weirmeir, Leduc (CA); Andrew J. Hanson, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 287 days.

(21) Appl. No.: 15/682,907

(22) Filed: Aug. 22, 2017

(65) Prior Publication Data

US 2019/0063185 A1 Feb. 28, 2019

(51) Int. Cl.

| | |
|---|---|
| ***E21B 34/14*** | (2006.01) |
| ***E21B 23/06*** | (2006.01) |
| ***E21B 33/128*** | (2006.01) |
| ***E21B 34/10*** | (2006.01) |

(52) U.S. Cl.

CPC ..... *E21B 34/14* (2013.01); *E21B 23/06* (2013.01); *E21B 33/128* (2013.01); *E21B 34/10* (2013.01)

(58) Field of Classification Search

CPC ..... E21B 34/14; E21B 23/06; E21B 33/128; E21B 34/10; E21B 34/00

See application file for complete search history.

(56) References Cited

U.S. PATENT DOCUMENTS

| | | | | |
|---|---|---|---|---|
| 3,543,847 | A * | 12/1970 | Haeber | E21B 33/043 166/348 |
| 4,601,342 | A * | 7/1986 | Pringle | E21B 34/08 166/323 |
| 6,024,173 | A | 2/2000 | Patel et al. | |
| 6,446,727 | B1 | 9/2002 | Zemlak et al. | |
| 7,909,102 | B1 | 3/2011 | Hernandez et al. | |
| 8,276,674 | B2 * | 10/2012 | Lopez de Cardenas | E21B 43/08 166/373 |
| 8,794,331 | B2 | 8/2014 | Getzlaf et al. | |
| 9,234,412 | B2 | 1/2016 | Getzlaf et al. | |
| 2004/0031610 | A1 * | 2/2004 | Schultz | E21B 43/103 166/285 |

(Continued)

FOREIGN PATENT DOCUMENTS

WO 2016026024 A1 2/2016

OTHER PUBLICATIONS

Resource Well Completion Technologies Inc.; "Zone Striker Hydraulic Sleeve" Product No. 40-420, dated Jul. 2017, 1 page.

(Continued)

*Primary Examiner* — D. Andrews

(74) *Attorney, Agent, or Firm* — Smith IP Services, P.C.

(57) ABSTRACT

A shifting tool can include a flow restrictor outwardly extendable in a well. A method can include flowing a fluid through a flow restriction, thereby creating a pressure differential and, in response, shifting a closure member while the fluid flows through the flow restriction. Another method can include positioning a shifting tool in a tubular string, then outwardly extending keys from the shifting tool in response to fluid pressure applied to the shifting tool, then engaging the keys with a profile formed in a closure member, and then shifting the closure member between open and closed positions.

12 Claims, 32 Drawing Sheets

(56) References Cited

U.S. PATENT DOCUMENTS

| | | | | |
|---|---|---|---|---|
| 2011/0226489 | A1 | 9/2011 | Hofman et al. | |
| 2011/0297263 | A1* | 12/2011 | Atkins | E03C 1/1222 138/44 |
| 2013/0306313 | A1* | 11/2013 | Geoffroy | E21B 43/04 166/278 |
| 2014/0345876 | A1* | 11/2014 | Coon | E21B 43/26 166/373 |
| 2015/0247379 | A1* | 9/2015 | Ringgenberg | E21B 34/10 166/374 |
| 2015/0285025 | A1 | 10/2015 | Hughes et al. | |
| 2015/0330185 | A1 | 11/2015 | Hughes et al. | |
| 2016/0053562 | A1 | 2/2016 | Frosell et al. | |
| 2017/0051574 | A1 | 2/2017 | Hughes et al. | |

OTHER PUBLICATIONS

Coiled Tubing Times; "Intergrated Approach to Coiled-Tubed Multistage Frac", ISSN 1817-3330, dated Mar. 1, 2016, 5 pages.
Weatherford; "Zoneselect Coiled Tubing (CT) Stimulation Sleeve System Operational Procedure", dated 2014, 1 page.
Weatherford; "Thru-Tubing Services", company article via http://www.weatherford.com, dated Jul. 24, 2017, 4 pages.
Search Report and Written Opinion dated Jan. 30, 2019 for International application PCT/US2018/044288, 19 pages.

* cited by examiner

SHIFTING TOOL AND ASSOCIATED METHODS FOR OPERATING DOWNHOLE VALVES

BACKGROUND

This disclosure relates generally to equipment utilized and operations performed in conjunction with a subterranean well and, in examples described below, more particularly provides a well system, a bottomhole assembly, a shifting tool and associated methods for operating downhole valves.

A bottomhole assembly can be used to selectively operate multiple downhole valves providing controllable communication with corresponding reservoir zones. In some situations, this selective operation of the downhole valves enables the respective reservoir zones to be individually or selectively fractured.

Therefore, it will be readily appreciated that improvements are continually needed in the art of designing, constructing and utilizing well systems, bottomhole assemblies, shifting tools and associated methods for operating downhole valves. Such improvements may be useful in situations where reservoir zones are to be individually or selectively fractured, or in other situations.

DETAILED DESCRIPTION

Figure 1:
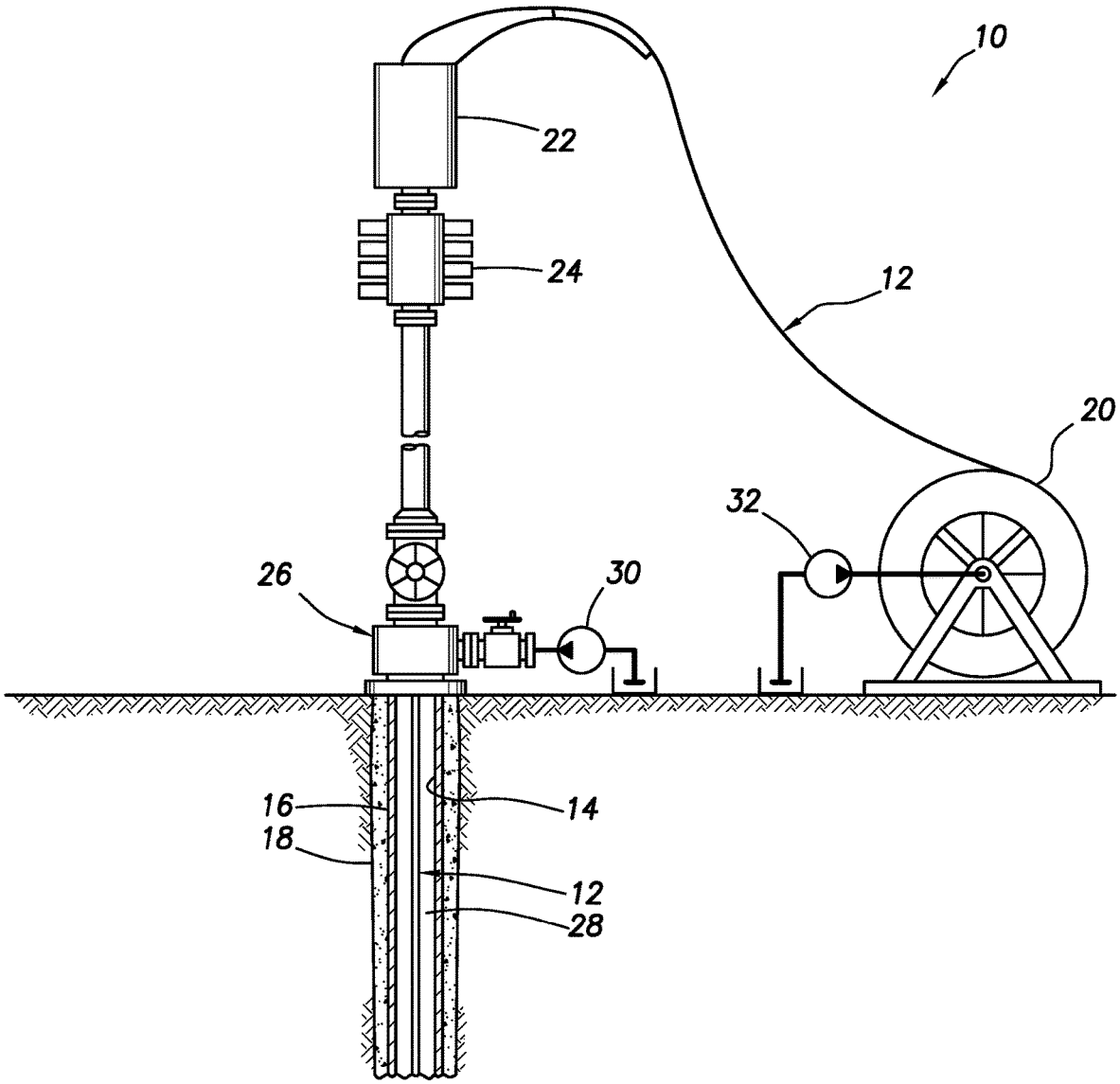
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubing string 12 is positioned in a wellbore 14 lined with casing 16 and cement 18. In this example, the tubing string 12 is of the type known to those skilled in the art as "coiled tubing," since the tubing is typically stored on a reel or spool 20 and is substantially continuous. The tubing string 12 is conveyed into the wellbore 14 via an injector 22, a blowout preventer stack 24 and a wellhead assembly 26.

Note that it is not necessary for the tubing string 12 to comprise coiled tubing. In other examples, jointed tubing or another type of conveyance may be used to convey and position a bottomhole assembly (not shown in FIG. 1, see FIGS. 3A-D) in the well. Thus, the scope of this disclosure is not limited to any of the specific details of the tubular string 12 or any other components or elements of the well system 10 as described herein or depicted in the drawings.

When the tubing string 12 is positioned in the well, an annulus 28 is formed radially between the wellbore 14 and the tubing string 12. Fluids, slurries, gels and other types of flowable substances may be flowed into the annulus 28 from surface, such as, using a pump 30 connected to the wellhead assembly 26. Similarly, fluids, slurries, gels and other types of flowable substances may be flowed into the tubing string 12 from surface, such as, using another pump 32 connected to a proximal end of the tubing string at the spool 20. Fluids and other flowable substances can also flow from downhole to surface via the annulus 28 and tubing string 12.

Figure 2A:
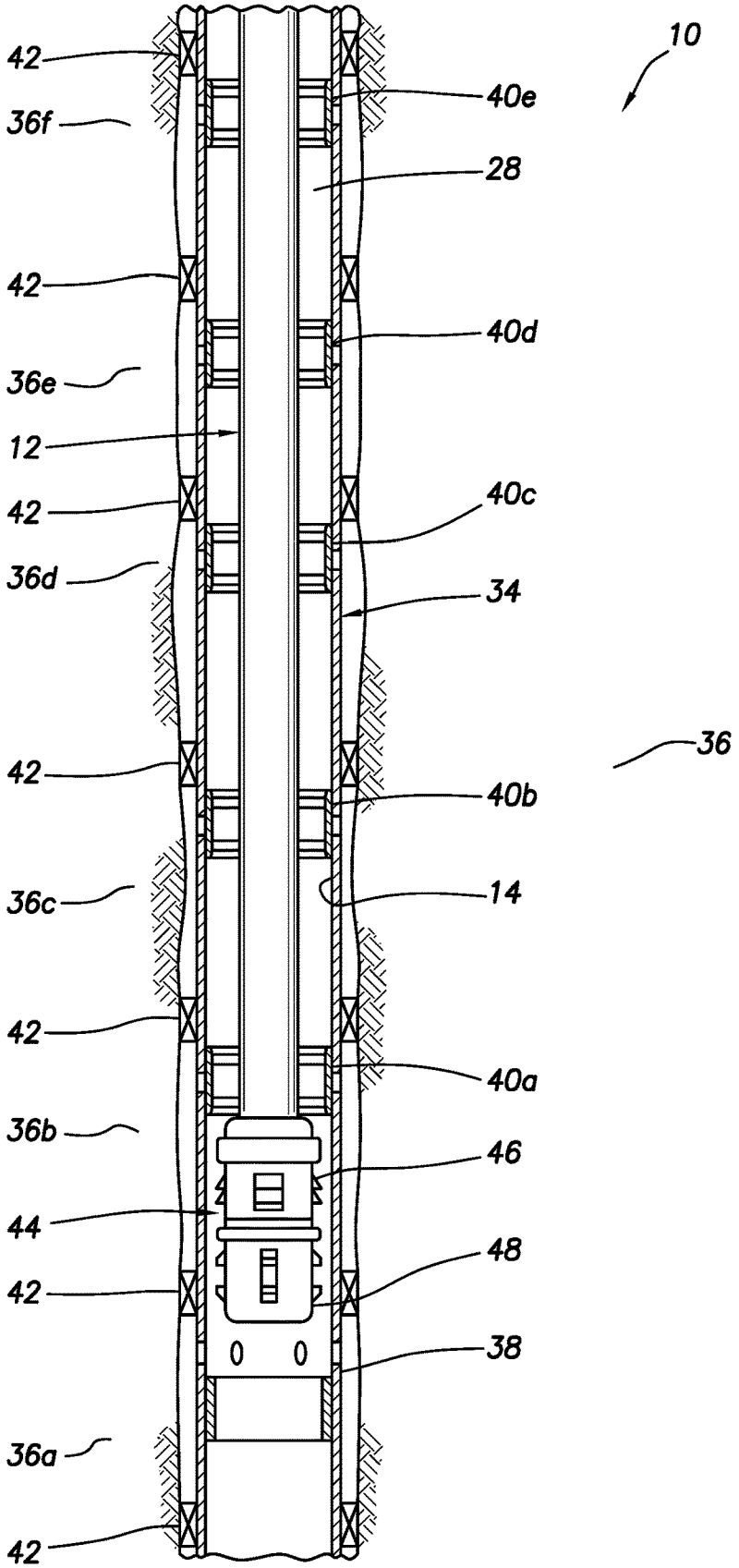
FIGS. 2A & B are representative partially cross-sectional views of example completions that may be used with the FIG. 1 well system.

Referring additionally now to FIGS. 2A & B, examples of completions that may be used with the well system 10 are representatively illustrated. However, it should be understood that the scope of this disclosure is not limited to completions of the types depicted in FIGS. 2A & B.

In the FIG. 2A example, a tubular string 34 has been positioned in an earth formation 36. The tubular string 34 could comprise a casing (such as the casing 16 of FIG. 1) or other tubulars known to those skilled in the art as liner, tubing or pipe. The scope of this disclosure is not limited to use of any particular type of tubular string.

A series of spaced apart downhole valves 38, 40*a-e* are connected in the tubular string 34. Each of the downhole valves 38, 40*a-e* provides for selective fluid communication between an interior of the tubular string 34 and a respective one of multiple formation zones 36*a-f*.

The zones 36*a-f* may be individual zones of the same formation 36, or they may be zones of multiple earth formations. Although a single one of the downhole valves 38, 40*a-e* is depicted in FIG. 2A as corresponding to a single one of the zones 36*a-f*, in other examples multiple valves could correspond to a single zone, or a single valve could correspond to multiple zones.

As depicted in FIG. 2A, the zones 36*a-f* are isolated from each other at the tubular string 34 by packers 42 positioned between adjacent zones. However, in other examples, cement or another type of annular barrier may be used to isolate the zones 36*a-f* from each other.

In the FIG. 2A example, the downhole valve 38 is pressure actuated. With the other downhole valves 40*a-e* closed, pressure in the tubular string 34 can be increased (such as, using one or both of the pumps 30, 32) to a predetermined level, at which point the valve 38 will open. Such pressure actuated valves are well known to those skilled in the art, and so are not further described herein.

In some examples, in which the wellbore 14 at the completion is horizontal or highly deviated, the downhole valve 38 may be of the type known to those skilled in the art as a "toe valve," since it is connected in the tubular string 34 at or near a "toe" or distal end of the tubular string. However, the scope of this disclosure is not limited to use of the downhole valve 38, or to use of any valve at or near a distal end of the tubular string 34.

As depicted in FIG. 2A, the other downhole valves 40*a-e* can be actuated using a bottomhole assembly (BHA) 44 connected in the tubing string 12. The BHA 44 is "bottomhole," in that it is connected at or near a distal or "bottom" end of the tubing string 12. It is not necessary for the BHA 44 to be positioned at or near a "bottom" or distal end of the wellbore 14.

In the FIG. 2A example, the BHA 44 includes a packer assembly 46 and a shifting tool 48. In other examples, other or different tools, sensors, etc., may be included in the BHA 44, or otherwise connected in the tubing string 12. Thus, the scope of this disclosure is not limited to any particular components (or number or combinations of components) in the BHA 44.

The packer assembly 46 is used to selectively seal off the annulus 28 between the BHA 44 and the wellbore 14. The packer assembly 46 also selectively secures the BHA 44 relative to the tubular string 34. When the packer assembly 46 is "set," the annulus 28 is sealed off at the packer assembly, and the packer assembly is secured against longitudinal displacement relative to the tubular string 34. In this example, the packer assembly 46 can be repeatedly set and "unset" (flow through the annulus 28 at the packer assembly is again permitted, and the packer assembly can displace longitudinally relative to the tubular string 34) downhole.

A suitable commercially available packer assembly for use in the well system 10 is the REELFRAC™ marketed by Weatherford International, Ltd. of Houston, Tex. USA. In the further description below, operation of the packer assembly 46 is described as if it is the same as, or operationally similar to, that of the REELFRAC™. However, the scope of this disclosure is not limited to use of any particular packer assembly.

The shifting tool 48 is used to actuate the downhole valves 40*a-e* between open and closed configurations. The shifting tool 48 can physically engage each of the downhole valves 40*a-e*. In some examples, the shifting tool 48 can include an extendable flow restrictor that increases a restriction to flow through the annulus 28 at a selected downhole valve 40*a-e*, in order to actuate the valve as described more fully below.

In an example method associated with the well system 10 completion depicted in FIG. 2A, the downhole valves 38, 40*a-e* are all initially closed. Pressure in the tubular string 34 is then increased, until the downhole valve 38 opens. The zone 36*a* is fractured by flowing fluids, slurries, gels, acids, spacers, etc., from the wellbore 14, through the open downhole valve 38 and into the zone 36*a*.

The tubing string 12, including the BHA 44, is then conveyed into the tubular string 34. The packer assembly 46 can be set and pressure tested, for example, above the open downhole valve 38 (e.g., in the position depicted in FIG. 2A).

After pressure testing, the packer assembly 46 can be unset and the BHA 44 can be positioned so that the shifting tool 48 engages the downhole valve 40*a*. The BHA 44 can then be displaced longitudinally downward (as viewed in FIG. 2A) to shift the downhole valve 40*a* to an open configuration.

The longitudinally downward displacement of the BHA 44 can be produced by slacking off on the tubing string 12 at surface (so that a weight of the tubing string 12 is applied to the BHA), or fluid pressure can be applied to the annulus 28 and/or an interior of the tubing string as described more fully below. In some examples, a combination of weight and fluid pressure may be used to displace the BHA 44 downward to shift the downhole valve 40*a* to the open configuration.

With the downhole valve 40*a* open, the BHA 44 can be displaced further downward, so that the shifting tool 48 is disengaged from the now-open downhole valve 40*a*, and the packer assembly 46 is positioned between the downhole valve 40*a* and the previously opened downhole valve 38. The packer assembly 46 can be set in this position to isolate the open downhole valve 38 from the wellbore 14 above the packer assembly.

The zone 36*b* is then fractured by flowing fluids, slurries, gels, acids, spacers, etc., from the wellbore 14, through the open downhole valve 40*a* and into the zone 36*b*. After the fracturing operation, the packer assembly 46 can be unset and the BHA 44 can be displaced longitudinally upward, so that the shifting tool 48 engages the downhole valve 40*a* and closes it.

The steps described above for fracturing the zone 36*b* can be repeated for each of the remaining zones 36*c-f*. These steps can include engaging the shifting tool 48 with the corresponding downhole valve 40*b-e*, opening the downhole valve, disengaging the shifting tool from the downhole valve, setting the packer assembly 46 below the open downhole valve, fracturing the corresponding zone 36*c-f*, and shifting the downhole valve to its closed configuration.

Note that, although six downhole valves 38, 40*a-e* and six zones 36*a-f* are depicted in FIG. 2A, any number of downhole valves or zones may exist in other examples. The downhole valves 38, 40*a-e* and zones 36*a-f* in some examples may not be "above" or "below" each other as depicted in FIG. 2A (such as, in situations where the wellbore 14 is horizontal or otherwise deviated from vertical), but may instead be more distal or proximal relative to the surface along the wellbore 14.

Figure 2B:
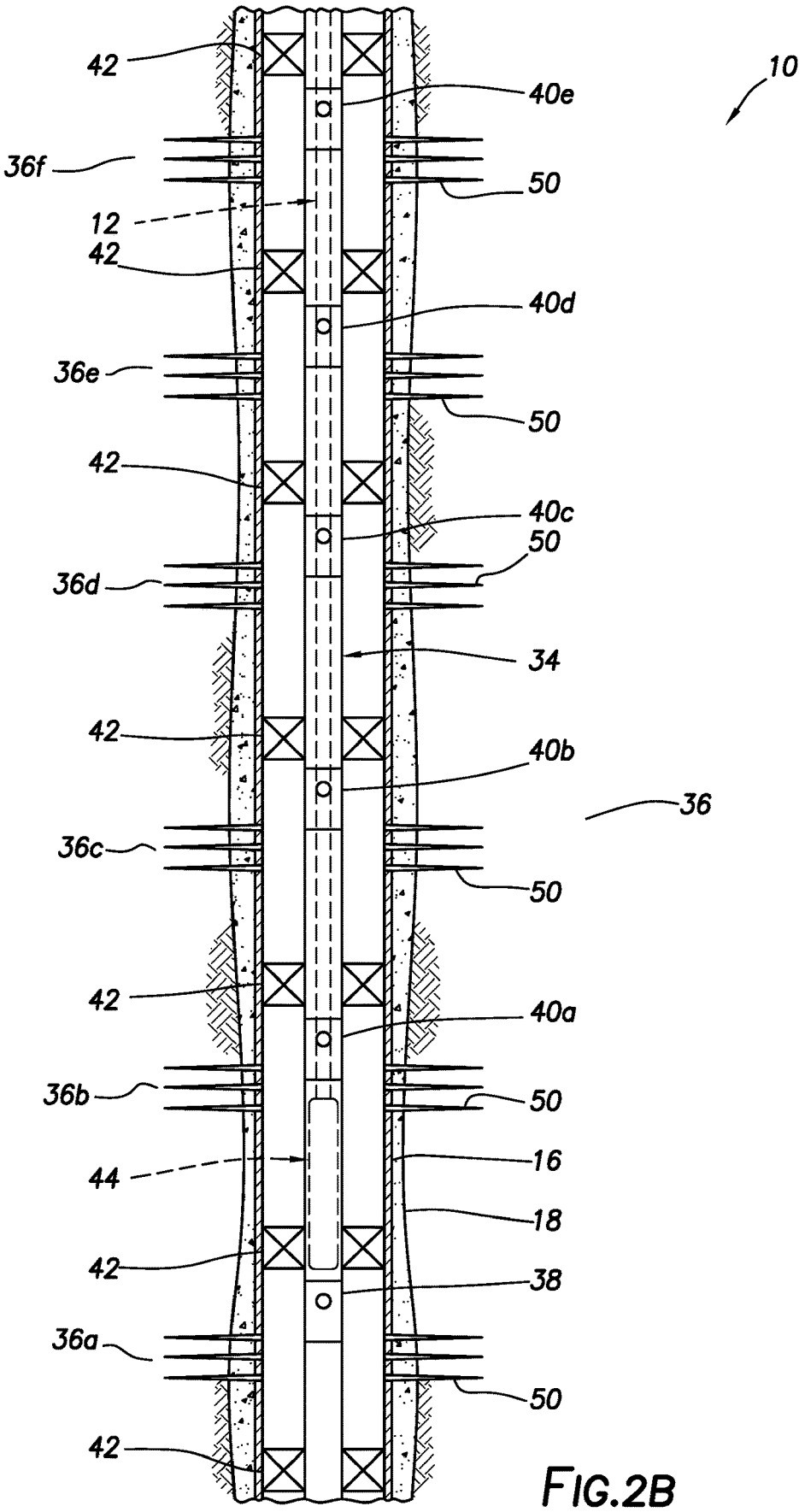

In the FIG. 2B example, the completion is similar in many respects to the FIG. 2A completion. However, in the FIG. 2B completion, the tubular string 34 is positioned in another tubular string in the well (such as, another liner or casing 16). The tubular string 34 in this example could be of the type known to those skilled in the art as production tubing, although other types of tubular strings may be used in keeping with the scope of this disclosure.

Fluid communication between an interior of the casing 16 and each of the zones 36*a-f* is provided by perforations 50. Thus, when one of the downhole valves 38, 40*a-e* is opened, fluid communication is permitted between the interior of the tubular string 34 and a corresponding one of the zones 36*a-f* via the associated perforations 50.

The bottom hole assembly 44 can be used as described above for the FIG. 2A completion to actuate the downhole valves 38, 40*a-e* in the FIG. 2B completion, in order to selectively fracture each of the zones 36*a-f*, or for other purposes (such as, acidizing or other stimulation operations, conformance treatments, steam or water flooding, production, etc.). Thus, it will be appreciated that the scope of this disclosure is not limited to use of the bottomhole assembly 44 in any particular completion, for any particular purpose or in any particular well operation.

Referring additionally now to FIGS. 3A-D, cross-sectional views of an example of the bottomhole assembly 44 are representatively illustrated. The BHA 44 of FIGS. 3A-D may be used in the well system 10 and completions of FIGS. 1-2B, or the BHA 44 may be used with other well systems and completions.

In the FIGS. 3A-D example, the BHA 44 includes the packer assembly 46 and the shifting tool 48. An upper internally threaded connector 52 is used to connect the BHA 44 in the tubing string 12 in the well system 10. In other examples, other or different tools, and different combinations of tools, may be included in the BHA 44.

When connected in the tubing string 12, an internal flow passage 54 extends longitudinally through the BHA 44 and the tubing string 12. As depicted in FIG. 3D, a check valve 56 at a distal end of the BHA 44 permits upward flow into the flow passage 54 (in a "reverse" circulation direction), but prevents downward flow through the flow passage 54 (in a "forward" circulation direction).

Ports 58 permit fluid communication between an interior and an exterior of the BHA 44 below the check valve 56. Thus, fluid can flow from the exterior of the BHA 44 to the interior flow passage 54 via the ports 58, and upward through the BHA via the check valve 56 in the reverse circulation direction. Forward circulation through the check valve 56 is prevented.

Figure 3A:
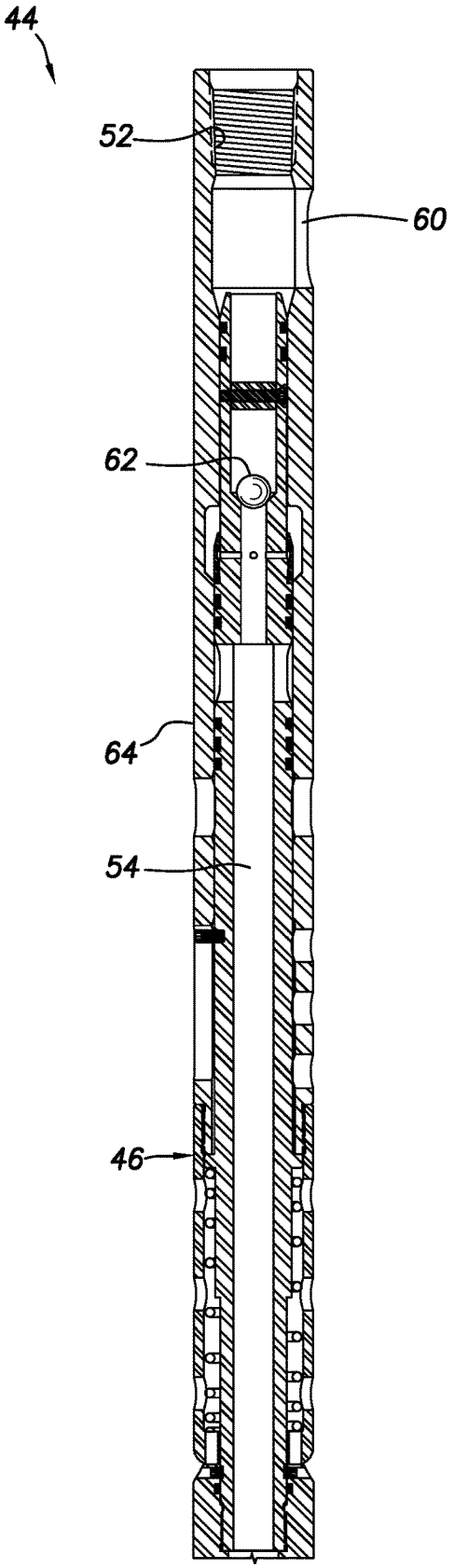
FIGS. 3A-D are representative cross-sectional views of successive axial sections of an example of a bottomhole assembly that may be used in the well system and completions of FIGS. 1-2B.
Figure 3B:
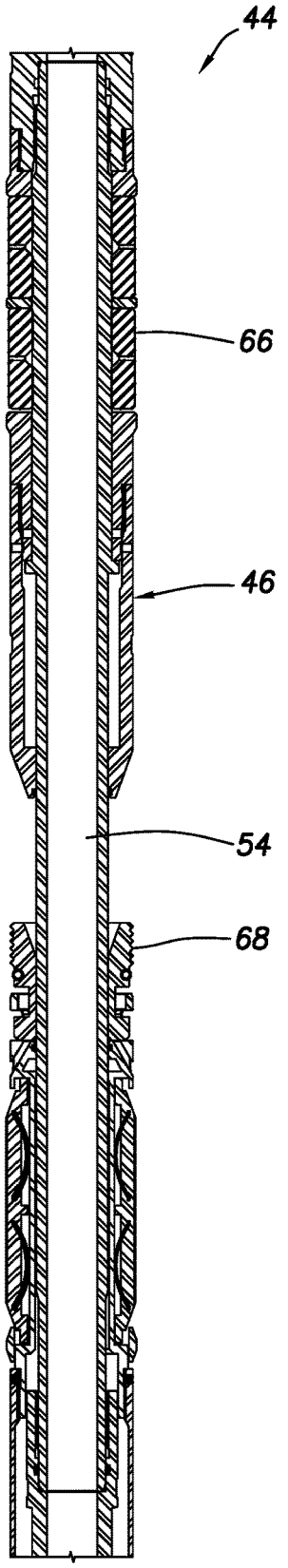
Figure 3C:
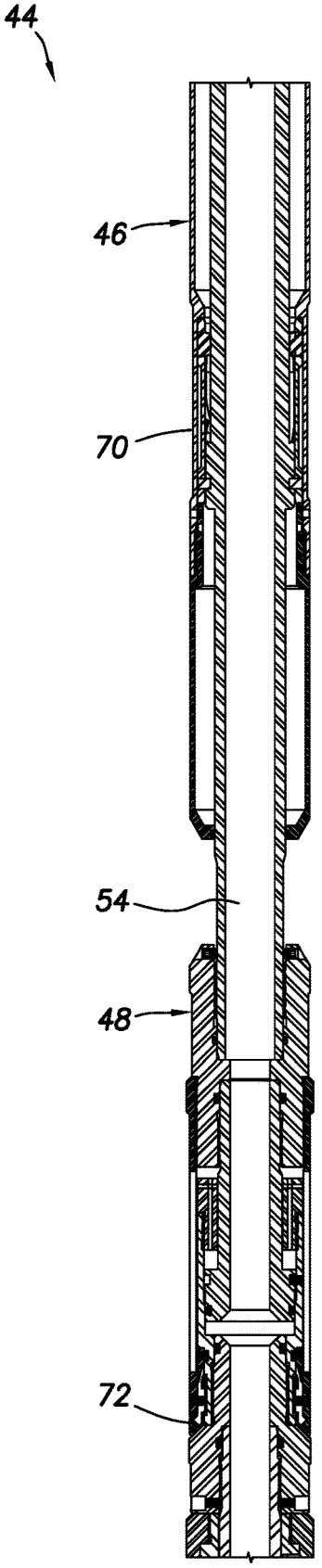
Figure 3D:
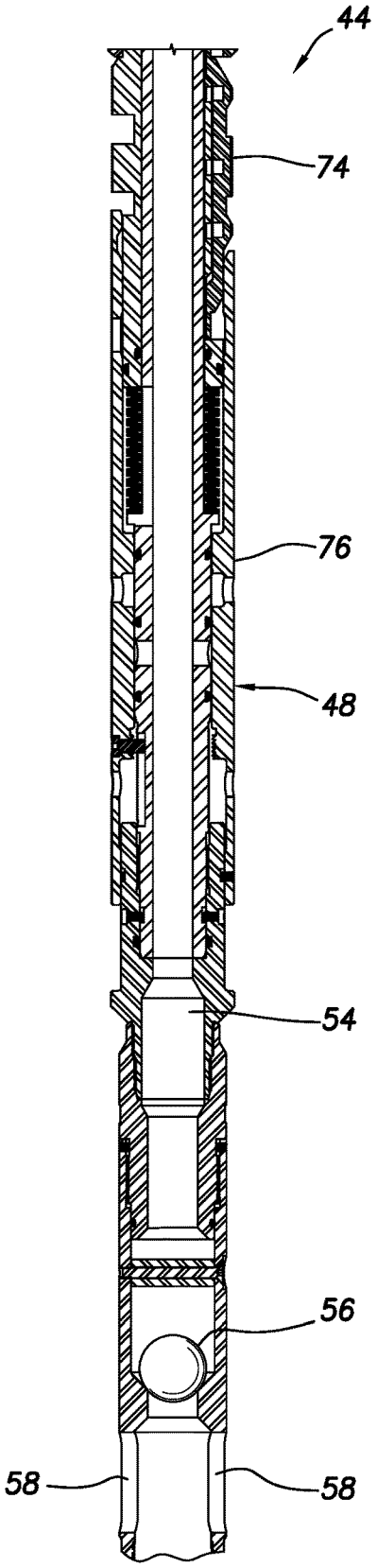

As depicted in FIG. 3A, another port 60 below the upper connector 52 permits fluid communication between the interior and exterior of the BHA 44. Another check valve 62 positioned below the port 60 prevents flow into the flow passage 54 below the check valve 62 in a forward circulation direction, but permits flow upward through the flow passage 54.

In the FIGS. 3A-D example, the packer assembly 46 includes an unloader valve 64, a packer 66, an anchor 68 and a setting controller 70. Other or different combinations of components may be used in the packer assembly 46 in other examples.

The unloader valve 64 is initially closed, as depicted in FIG. 3A. In response to a sufficient upwardly directed force applied to the upper connector 52 via the tubing string 12, the unloader valve 64 opens and thereby permits fluid communication between the interior and exterior of the BHA 44 (e.g., between the flow passage 54 and the annulus 28 in the well system 10).

Note that the unloader valve 64 is positioned longitudinally between the check valves 56, 62. In addition, note that each of the check valves 56, 62 is positioned longitudinally between the unloader valve 64 and the corresponding one of the ports 58, 60.

The packer 66 is used to seal off an annulus outwardly surrounding the BHA 44. In the well system 10, the packer 66 when set can seal off the annulus 28 radially between the BHA 44 and the tubular string 34.

The anchor 68 is used to secure the BHA 44 in position. In the well system 10, the anchor 68 when set can secure the BHA 44 against longitudinal displacement relative to the tubular string 34.

The setting controller 70 is used in this example to control whether or not the packer assembly 46 sets in response to manipulation of the BHA 44. The setting controller 70 allows the packer assembly 46 to be set every other time the BHA 44 is reciprocated upward and downward in a tubular string (such as the tubular string 34 in the well system 10). In other examples, the setting controller 70 may allow the packer assembly 46 to be set every third reciprocation, two out of three reciprocations, or any other number of times per any number of reciprocations. The packer assembly 46 can be unset by applying a sufficient upwardly directed force at the upper connector 52 (e.g., by picking up on the tubular string 12 at the surface).

In the FIGS. 3A-D example, the shifting tool 48 includes an outwardly extendable flow restrictor 72, one or more engagement members or keys 74, and a bypass valve 76. Other or different combinations of components may be used in the shifting tool 48 in other examples.

The flow restrictor 72 is used to increase a restriction to flow through the annulus outwardly surrounding the BHA 44 (e.g., the annulus 28 in the FIGS. 1-2B examples). Viewed differently, the flow restrictor 72 can increase fluid friction across the BHA 44, thereby increasing a longitudinal force applied to the BHA due to fluid flow through the annulus external to the BHA.

This longitudinal force can be used to operate a downhole valve (such as, any of the downhole valves 40*a-e*) when the keys 74 are engaged with the downhole valve. The keys 74 in this example are shaped to cooperatively engage a profile (not shown in FIGS. 3A-D, see FIG. 7) in the downhole valve, so that the longitudinal force is transmitted from the BHA 44 to the downhole valve.

Note that a longitudinal force applied to the BHA 44 is not necessarily produced by fluid flow across the BHA. For example, set down weight may be applied to the BHA 44 by slacking off on the tubing string 12 at the surface, or tension may be applied to the BHA by picking up on the tubing string 12 at the surface. Pressure may be increased or decreased in the flow passage 54 and/or annulus 28 to thereby produce a desired longitudinal force applied to the BHA 44. Thus, the scope of this disclosure is not limited to any particular technique, or combination of techniques, for producing a desired longitudinal force applied to the BHA 44.

In the FIGS. 3A-D example, the keys 74 have an external profile that engages an internal profile in a downhole valve. In other examples, other types of engagement members (such as, collets, dogs, gripping members, projections, receptacles, etc.) may be used for engaging and operating the downhole valve.

The bypass valve 76 is initially closed, but is used to selectively permit fluid communication between the interior and exterior of the BHA 44 (e.g., between the flow passage 54 and the annulus 28 in the well system 10). Thus, the bypass valve 76 is similar in this respect to the unloader valve 64. However, the bypass valve 76 opens in response to application of a predetermined pressure differential from the interior to the exterior of the BHA 44 (e.g., from the flow passage 54 to the annulus 28 in the well system 10).

Note that the bypass valve 76 is positioned longitudinally between the packer 66 and the check valve 56. In addition, note that the packer 66 is positioned longitudinally between the unloader and bypass valves 64, 76. Thus, when the unloader and bypass valves 64, 76 are open, pressure across the packer 66 is equalized.

Initially, when the BHA 44 is conveyed into the well, the unloader and bypass valves 64, 76 are closed, the packer assembly 46 is unset (the packer 66 and anchor 68 are inwardly retracted), and the flow restrictor 72 and keys 74 of the shifting tool 48 are inwardly retracted. In this configuration, the BHA 44 can be conveniently conveyed through the tubular string 34 in the well system 10.

While running in, the check valves 56, 62 permit fluid in the tubular string 34 below the BHA 44 to flow upward through the BHA. Fluid can also be reverse or forward circulated through the tubing string 12 and annulus 28 via the port 60.

Figure 4A:
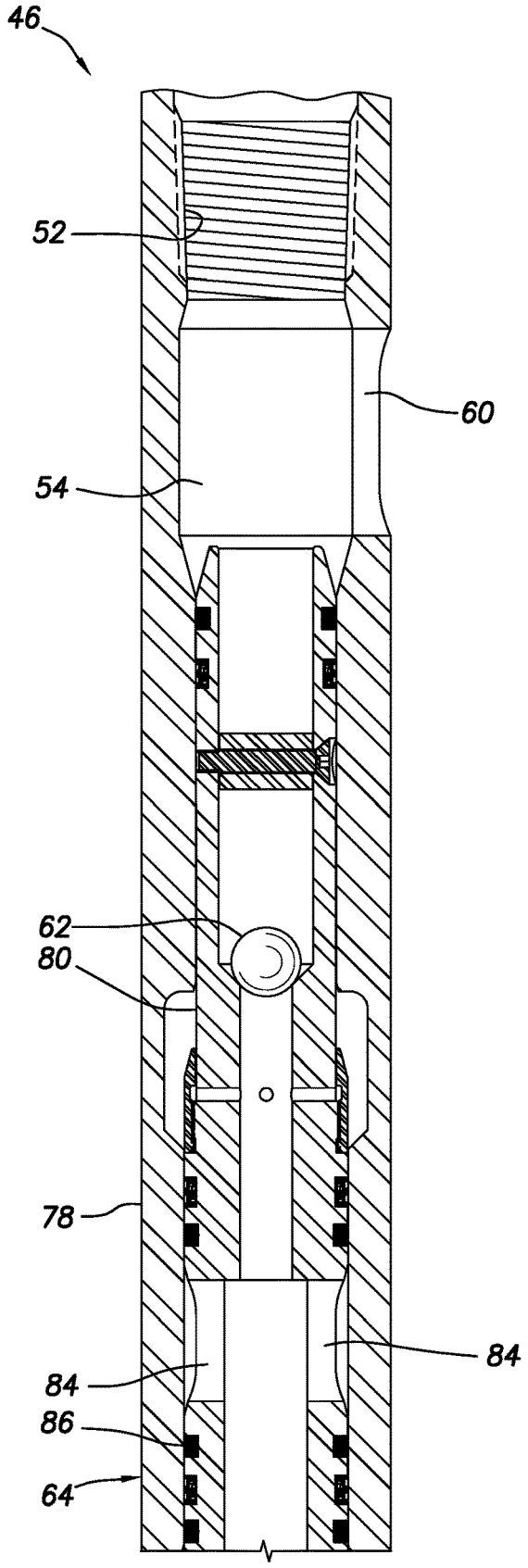
FIGS. 4A & B are representative cross-sectional views of successive axial sections of an example of an unloader valve section of a packer assembly that may be used in the bottomhole assembly of FIGS. 3A-D.
Figure 4B:
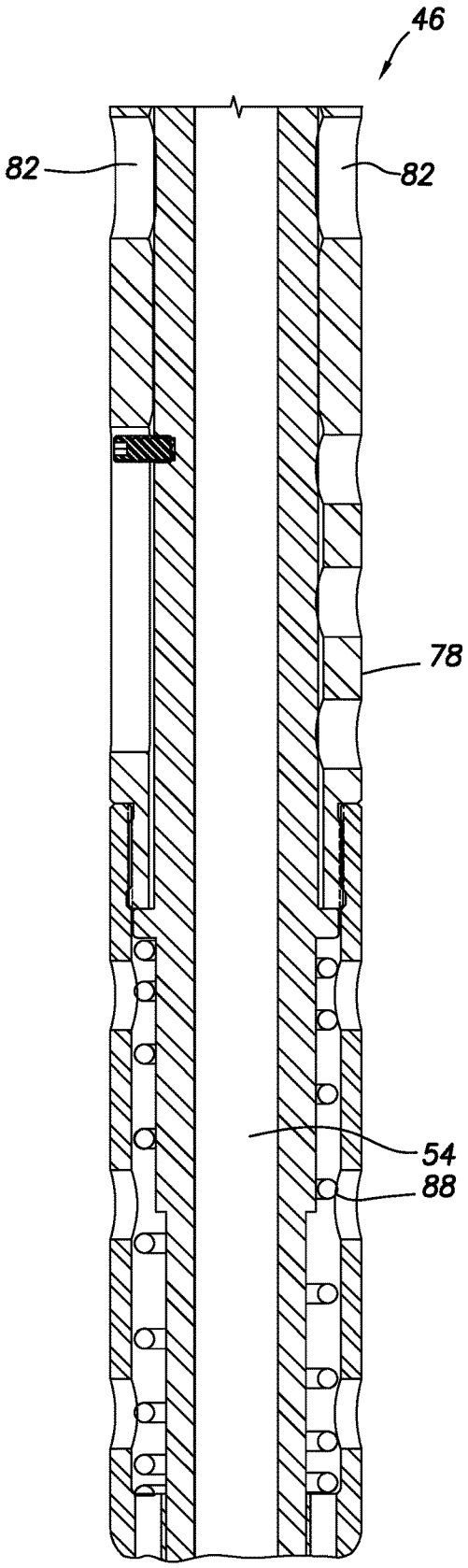

Referring additionally now to FIGS. 4A-B, more detailed cross-sectional views of an unloader valve section of the packer assembly 46 are representatively illustrated. In these views it may be seen that the unloader valve 64 includes an outer generally tubular housing 78 reciprocably disposed on an inner generally tubular mandrel 80.

Ports 82, 84 formed through the respective outer housing 78 and inner mandrel 80 are initially separated and isolated by seals 86. However, when a sufficient longitudinally upwardly directed force is applied to the outer housing 78, with the inner mandrel 80 being secured against longitudinal displacement (such as, by setting the packer assembly 46 as described more fully below), the outer housing will displace upward relative to the inner mandrel 80, thereby aligning the ports 82, 84 and permitting fluid communication between the interior and exterior of the packer assembly 46.

A biasing device 88 (such as, a spring) applies an upwardly directed longitudinal force to the inner mandrel 80 relative to the outer housing 78, so that the outer housing is continually biased downward relative to the inner mandrel. Note that, when the packer assembly 46 is set by applying a downwardly directed longitudinal force to the packer assembly, the unloader valve 64 will be closed, since the inner mandrel 80 is connected to the packer 66 and the downwardly directed setting force is applied via the outer housing 78.

Figure 5A:
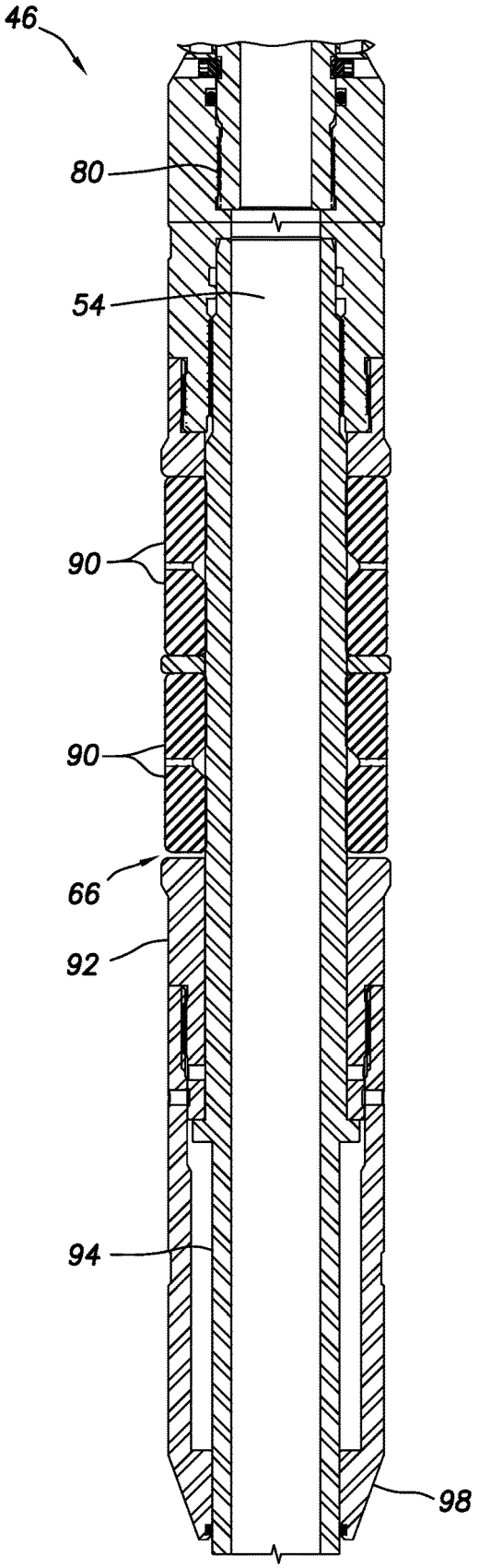
FIGS. 5A-C are representative cross-sectional views of examples of respective packer, anchor and setting control sections of the packer assembly.
Figure 5B:
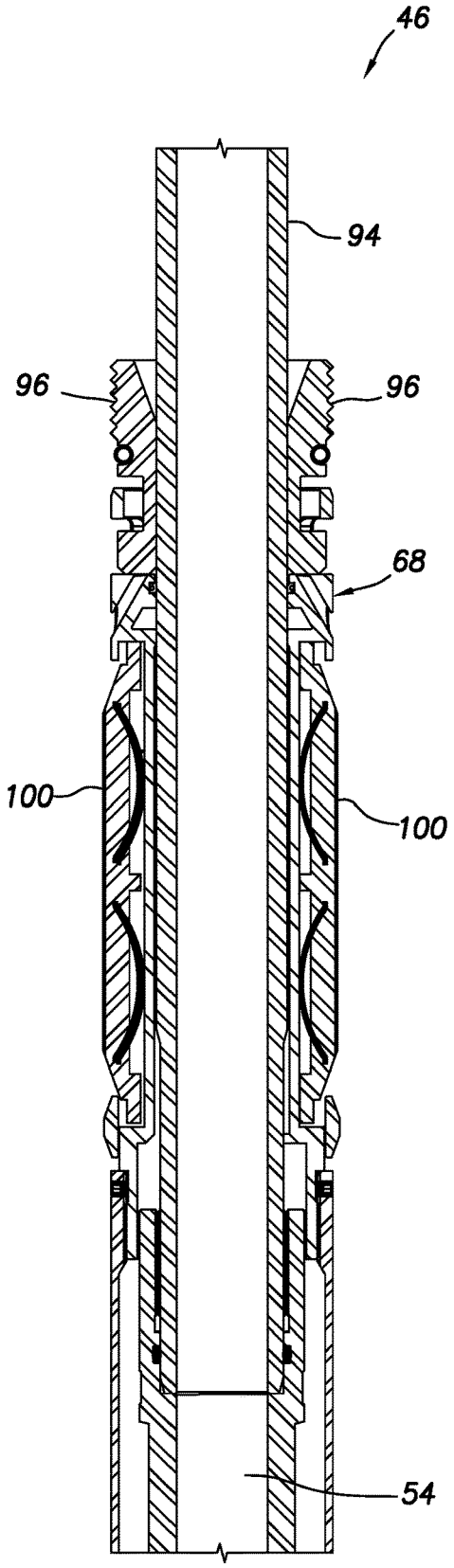
Figure 5C:
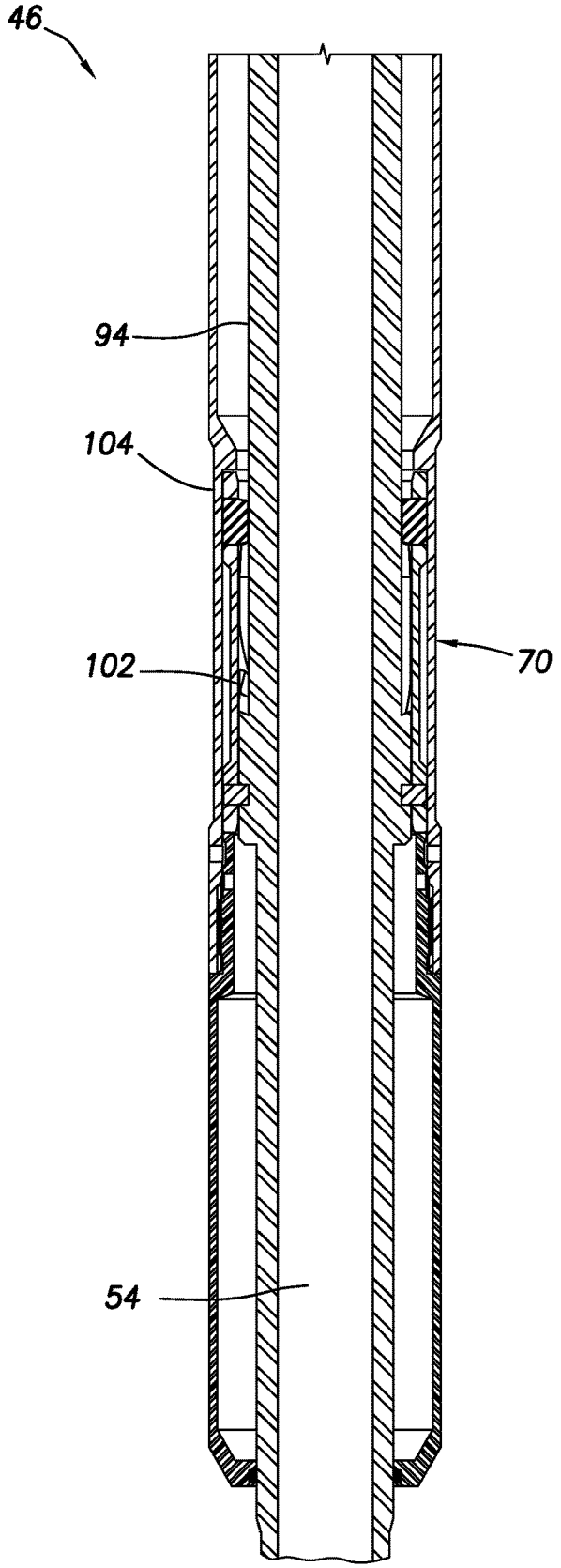

Referring additionally now to FIGS. 5A-C, more detailed cross-sectional views of examples of packer, anchor and setting control sections of the packer assembly 46 are representatively illustrated. In these views it may be seen that the packer assembly 46 can be similar to, or the same as, a conventional resettable compression-set packer of the type well known to those skilled in the art, in this case the Weatherford REELFRAC™ packer mentioned above.

As such, the packer, anchor and setting control sections of the packer assembly 46 are not described in detail herein. However, the scope of this disclosure is not limited to use of any particular type of packer assembly in the BHA 44.

As depicted in FIG. 5A, the packer 66 includes multiple annular seal elements 90. The seal elements 90 extend radially outward into sealing contact with a surface outwardly surrounding the packer 66 (such as, an interior surface of the tubular string 34 in the well system 10) in response to longitudinal compression of the seal elements.

The seal elements 90 are longitudinally compressed by downwardly displacing an inner mandrel 94 relative to an outer sleeve 92. The inner mandrel 94 is connected to the inner mandrel 80 described above.

As depicted in FIG. 5B, the anchor 68 includes outwardly extendable slips 96. When the inner mandrel 94 displaces downward relative to the slips 96, a frusto-conical wedge surface 98 will eventually contact and radially outwardly bias the slips 96 into gripping engagement with the surface outwardly surrounding the packer 66 (such as, the interior surface of the tubular string 34 in the well system 10).

A set of drag blocks 100 are outwardly biased into sliding contact with the surface, and are provided with a friction-enhancing surface, so that the drag blocks and slips 96 can resist longitudinal displacement relative to the interior surface. This enables the wedge surface 98 to displace into engagement with the slips 96 when the slips are not yet grippingly engaged with the interior surface.

The drag blocks 100 also assist in operation of the setting controller 70. In the FIG. 5C example, the setting controller 70 includes a J-slot type ratchet device 102. The ratchet device 102 controls an extent of relative longitudinal displacement between the inner mandrel 94 and an outer housing 104 connected to the drag blocks 100.

The ratchet device 102 permits the inner mandrel 94 to displace longitudinally downward relative to the outer housing 104 sufficiently far to outwardly extend the seal elements 90 and the slips 96 (due to contact between the wedge surface 98 and the slips), and thereby set the packer assembly 46, in response to every third (or whichever sequence of setting relative to not setting is desired) longitudinal reciprocation of the inner mandrel 94 (upward then downward displacement of the inner mandrel via the tubing string 12 in the well system 10). On certain downward displacements of the inner mandrel 94, the packer assembly 46 is not set, thus allowing the BHA 44 to be conveyed into the well without setting the packer assembly.

Figure 6A:
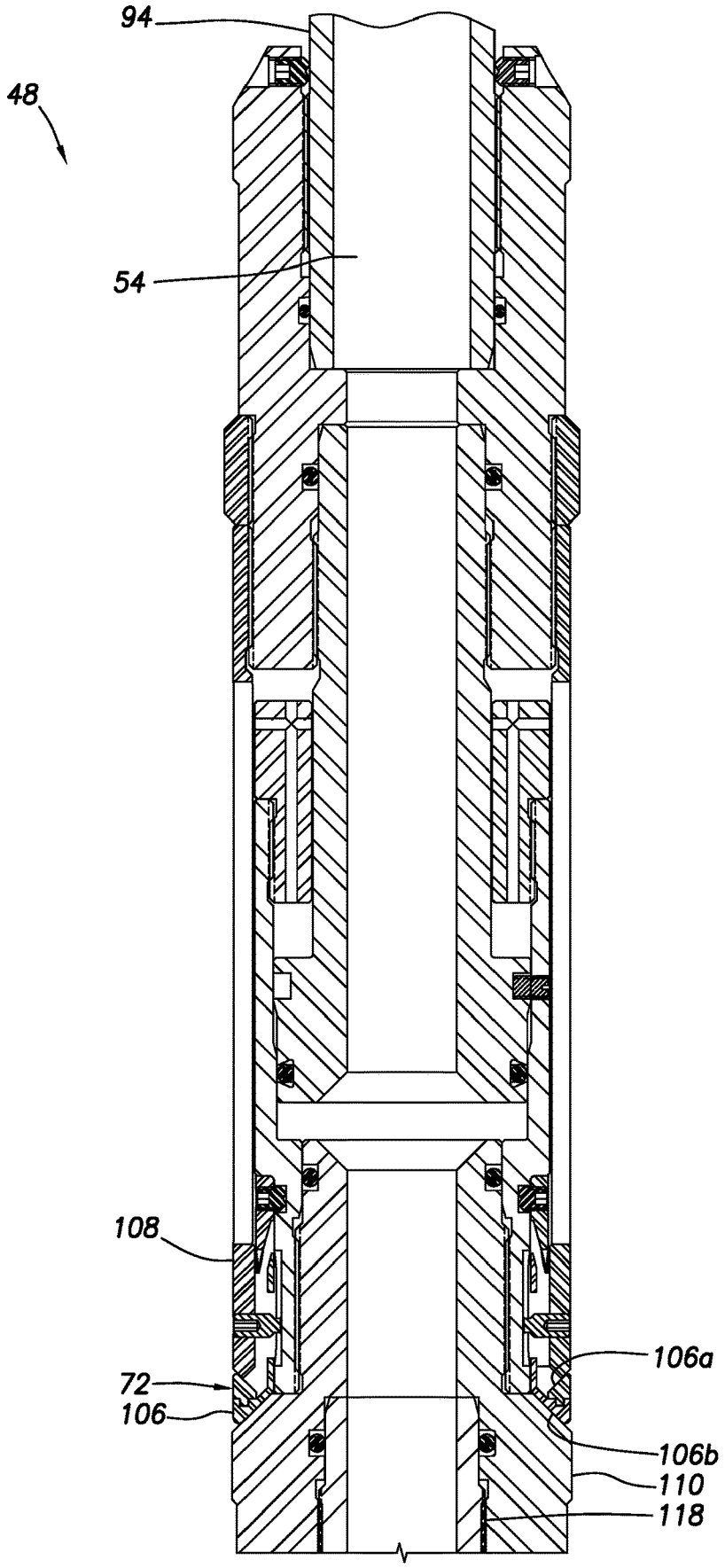
FIGS. 6A-C are representative cross-sectional views of successive axial sections of an example of a shifting tool that may be used in the bottomhole assembly.
Figure 6B:
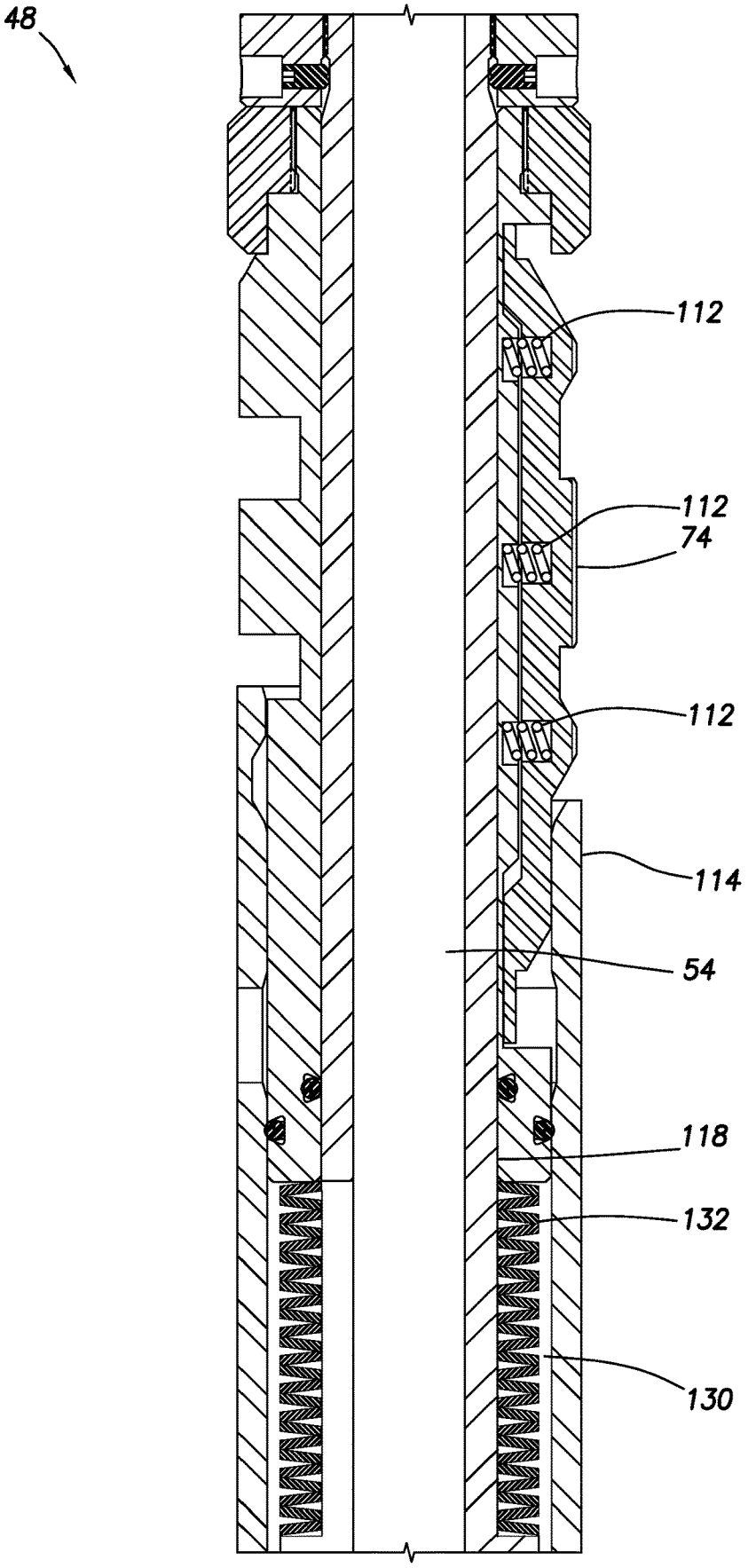
Figure 6C:
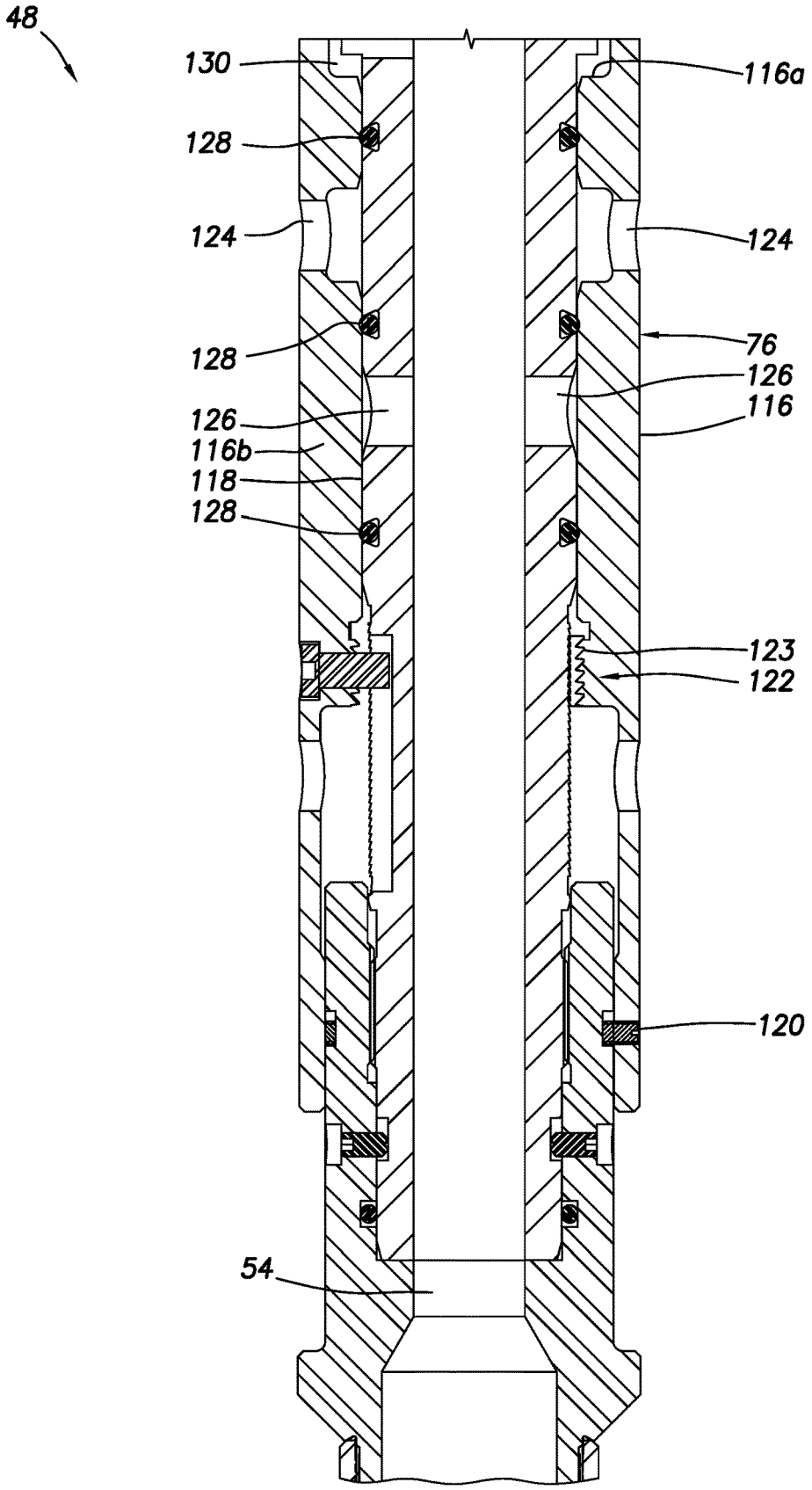

Referring additionally now to FIGS. 6A-C, more detailed cross-sectional views of flow restrictor, engagement member and bypass valve sections of an example of the shifting tool 48 are representatively illustrated. The FIGS. 6A-C shifting tool 48 may be used with the BHA 44 and well system 10 described above, or the shifting tool may be used with other bottom hole assemblies or other well systems.

In FIG. 6A, it may be seen that the flow restrictor 72 includes a multi-component radially expandable resilient ring 106. In one example, the ring 106 can include multiple rings having offset or opposed slots which form a tortuous path for fluid flow when the ring is radially expanded.

In the FIG. 6A example, the ring 106 has an internal inclined surface 106*a* facing an outer sleeve 108, and an internal inclined surface 106*b* facing a similarly shaped housing 110. The outer sleeve 108 has a lower end complementarily shaped relative to the inclined surface 106*a*, so that longitudinally downward displacement of the outer sleeve 108 relative to the ring 106 will cause the ring to expand radially outward between the outer sleeve and the housing 110.

Note that the outer sleeve 108 is connected to the inner mandrel 94 of the packer assembly 46. Thus, the outer sleeve 108 is connected to the tubing string 12 in the well system 10 via the inner mandrels 80, 94 and outer housing 78 of the packer assembly 46.

As depicted in FIG. 6B, the keys 74 are biased radially outward by springs 112. However, the keys 74 are initially retained in a retracted position by an outer generally tubular retainer 114.

In this example, the retainer 114 is formed on an upper end of an outer sleeve 116 of the bypass valve 76, as depicted in FIG. 6C. In other examples, the retainer 114 and the outer sleeve 116 may be separate components. The outer sleeve 116 is initially prevented from displacing longitudinally relative to an inner generally tubular mandrel 118 by a shear member 120 (such as, a shear pin, screw or ring).

A ratchet device 122 (such as, a body lock ring 123 positioned between the outer sleeve 116 and the inner mandrel 118) permits downward displacement of the outer sleeve relative to the inner mandrel after the shear member 120 has sheared, but prevents upward displacement of the outer sleeve relative to the inner mandrel.

Ports 124, 126 formed through the respective outer sleeve 116 and inner mandrel 118 are initially separated and isolated by seals 128. However, when a sufficient longitudinally downwardly directed force is applied to the outer sleeve 116 by increasing pressure applied to the flow passage 54, the outer sleeve will displace downward relative to the inner mandrel 118, thereby aligning the ports 124, 126 and permitting fluid communication between the interior and exterior of the shifting tool 48.

The outer sleeve 116 displaces downward in response to a pressure differential from the interior to the exterior of the shifting tool 48. Pressure in the flow passage 54 is communicated to a chamber 130 exposed to an internal annular differential piston area 116*a* in the outer sleeve 116. Another portion of the outer sleeve 116 functions as a closure member 116*b* that initially blocks flow through the ports 126.

Springs 132 positioned in the chamber 130 bias the keys 74 longitudinally upward. After the retainer 114 has displaced downward, thereby releasing the keys 74 to be outwardly extended by the springs 112, the keys can again be retracted by displacing the keys longitudinally downward relative to the sleeve 116 against the biasing force exerted by the springs 132 (e.g., with the keys engaged with an internal profile and the inner mandrel 118 being displaced upward with the tubing string 12 in the well system 10), so that the keys are again received in the retainer 114. This allows the keys 74 to be released from an internal profile downhole by applying a sufficient upwardly directed force to the inner mandrel 118 (e.g., via the tubing string 12).

Figure 7:
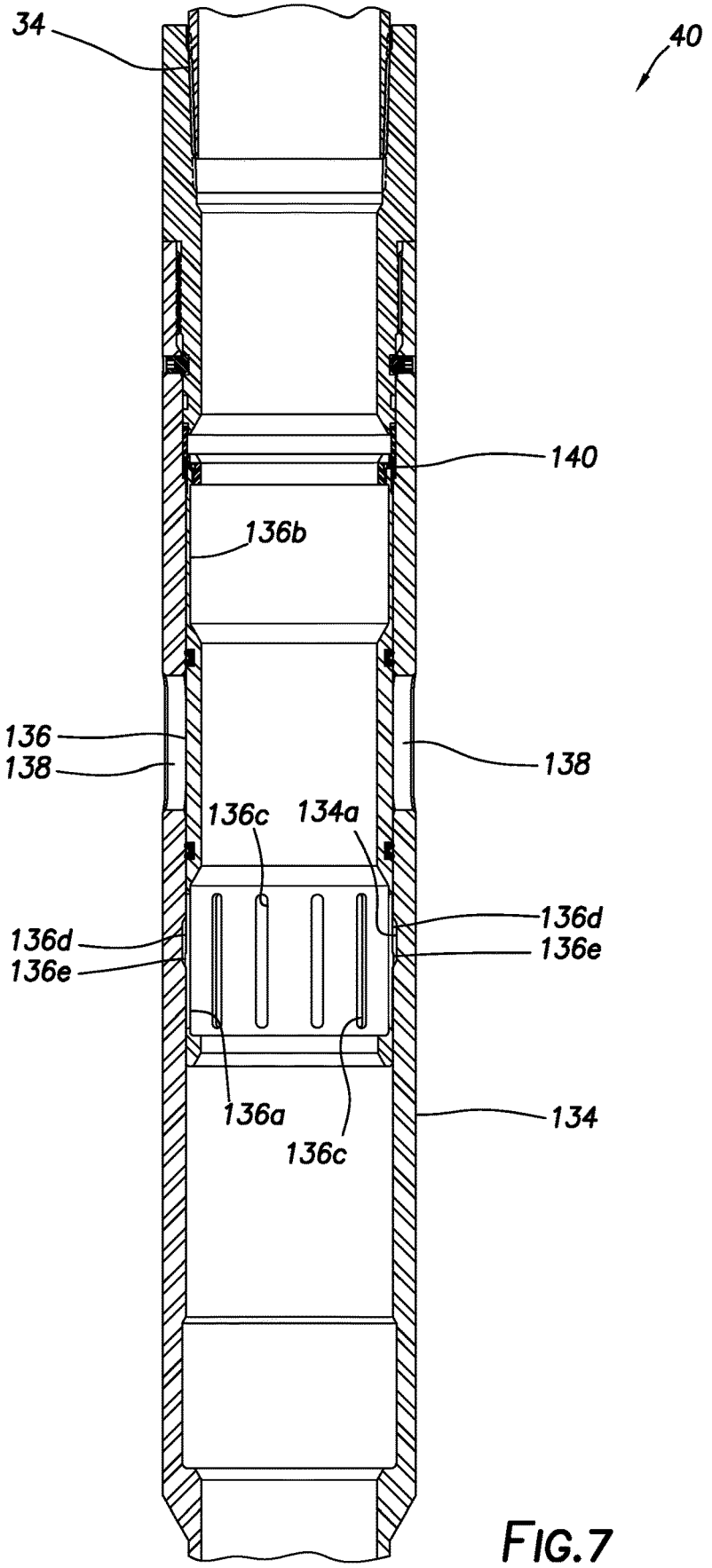
FIG. 7 is a representative cross-sectional view of an example of a downhole valve that may be used in the well system and completions of FIGS. 1-2B.

Referring additionally now to FIG. 7, a cross-sectional view of an example of a downhole valve 40 is representatively illustrated. The FIG. 7 downhole valve 40 may be used for any of the downhole valves 40*a-e* in the well system 10 of FIGS. 1-2B, or it may be used in other well systems.

As depicted in FIG. 7, the downhole valve 40 includes an outer generally tubular housing 134 and an inner generally tubular closure member 136 (such as, a sleeve). In a closed configuration, the closure member 136 blocks fluid communication through ports 138 formed through the outer housing 134. The closure member 136 is releasably retained in the closed configuration by a shear member 140 (such as, a shear pin, screw or ring).

Internal profiles 136*a,b* enable respective downwardly and upwardly directed longitudinal forces to be applied to the closure member 136. Slots 136*c* formed through the closure member 136 define resilient collets 136*d* having projections 136*e* formed thereon for releasable engagement with a recess 134*a* formed in the outer housing 134. The collets 136*d*, projections 136*e* and recess 134*a* enable the closure member 136 to be releasably retained in the closed position after the shear member 140 has been sheared.

The keys 74 of the shifting tool 48 (see FIG. 6B) are appropriately configured to engage the profile 136*a* when the shifting tool displaces downward through the downhole valve 40, so that a downwardly directed longitudinal force can be transmitted from the shifting tool to the closure member 136, in order to shift the closure member downward to an open position in which the ports 138 are open for fluid communication between an interior and an exterior of the downhole valve. The keys 74 are also appropriately configured to engage the profile 136*b* when the shifting tool displaces upward through the downhole valve 40, so that an upwardly directed longitudinal force can be transmitted from the shifting tool to the closure member 136, in order to shift the closure member upward to the closed position in which flow through the ports 138 is prevented.

The downhole valve 40 can be opened and closed repeatedly using the shifting tool 48. Note that it is not necessary for the shifting tool 48 to displace the closure member 136 or engage the profiles 136*a,b* every time the shifting tool 48 displaces through the downhole valve 40. For example, when the BHA 44 is initially run into the well, the keys 74 can be retracted and retained by the retainer 114 (see FIG. 6B), so that the keys do not engage the profile 136*a* as the shifting tool 48 displaces downward through the downhole valve 40.

Referring additionally now to FIGS. 8-21, cross-sectional views of the BHA 44 in operation in the well system 10 are representatively illustrated. Collectively, these views depict steps in an example of a method for operating the downhole valves 40*a-e* in the well system 10. However, the scope of this disclosure is not limited to any particular steps or combination of steps utilizing the BHA 44, and is not limited to a method performed with the well system 10.

In FIGS. 8-21, only the tubular string 34 (with the downhole valves 40*a-e*) and the tubing string 12 (with the BHA 44) are depicted for clarity of illustration and description. The steps depicted in FIGS. 8-21 may be performed with either of the completions illustrated in FIGS. 2A & B, or they may be performed with other types of completions.

Initially, the downhole valve 38 (see FIG. 1) is opened by applying increased pressure to the interior of the tubular string 34. The zone 36*a* can then be fractured by flowing fluid (e.g., proppant slurries, gels, acids, buffers, spacers, etc.) from surface, through the interior of the tubular string 34, and outward through the open valve 38.

Figure 8:
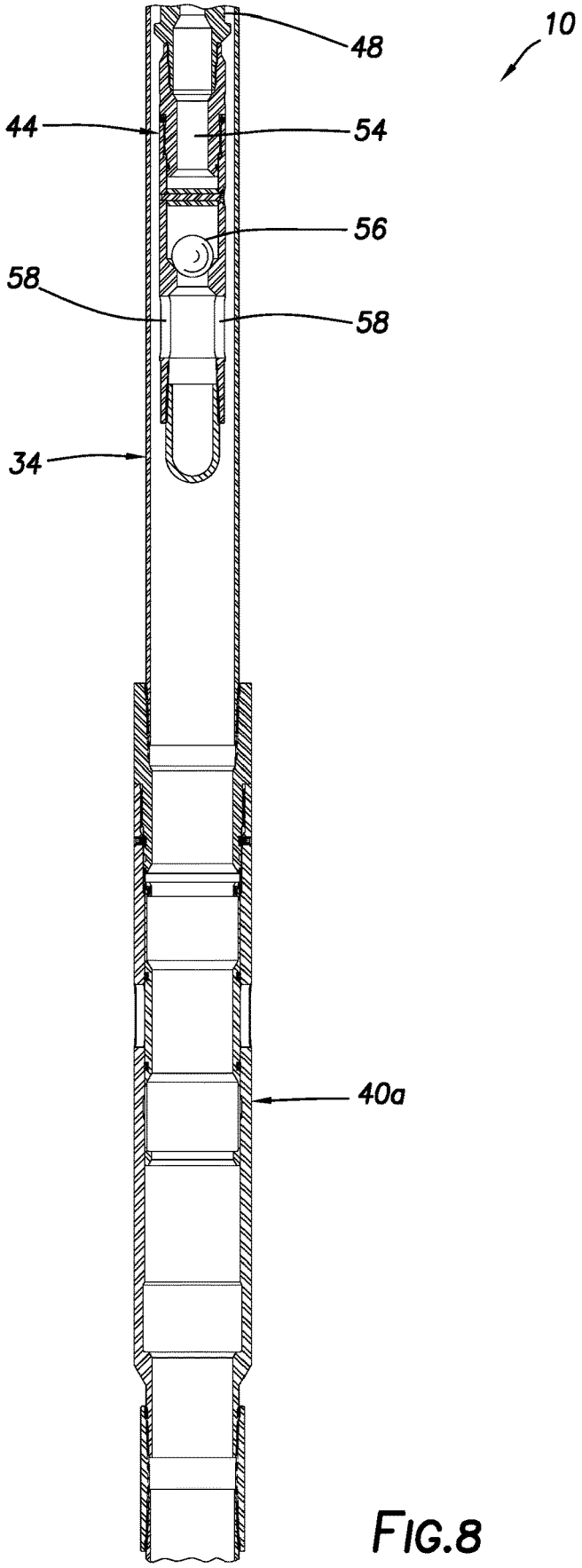
FIG. 8 is a representative cross-sectional view of the well system, in which the bottomhole assembly is being positioned in a tubular string.

After the initial zone 36*a* has been fractured, the tubing string 12 with the BHA 44 is conveyed into the tubular string 34 and positioned above the downhole valve 40*a* (longitudinally between the downhole valves 40*a,b*) as depicted in FIG. 8. As described above, fluid can flow upwardly through the BHA 44 via the check valves 56, 62, and forward and reverse circulation can be accomplished via the port 60 (see FIGS. 3A-D).

When the BHA 44 is initially run into the well, the unloader and bypass valves 64, 76 are closed, and the seal elements 90, slips 96 and keys 74 are in their retracted configurations. The downhole valve 38 is open, and the zone 36*a* is fractured. The remaining downhole valves 40*a-e* are closed. The BHA 44 is positioned between the downhole valves 40*a,b* as depicted in FIG. 8.

Figure 9A:
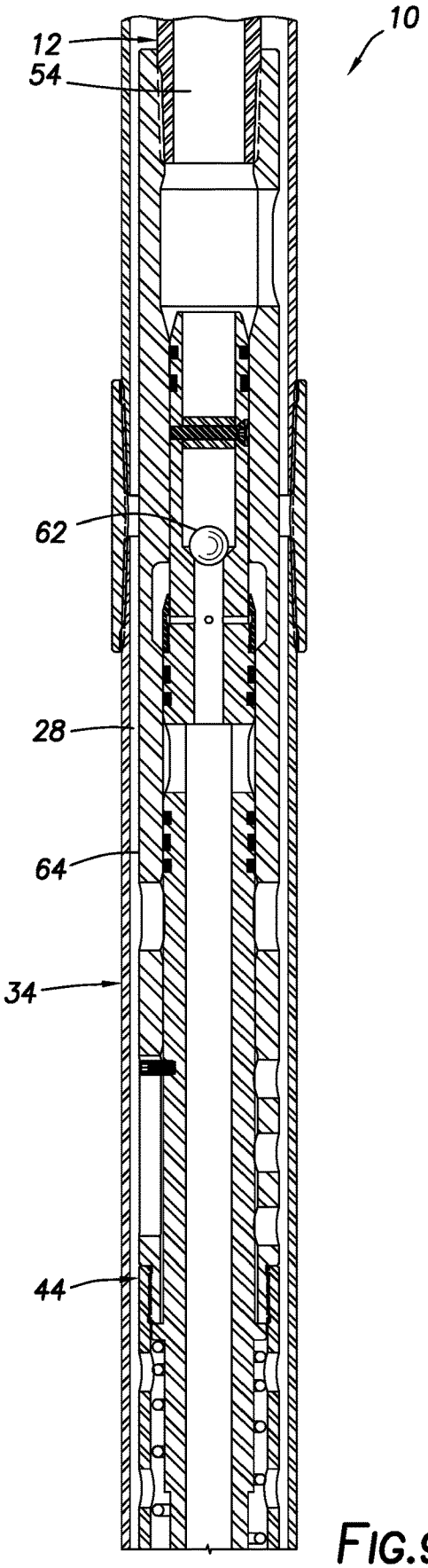
FIGS. 9A-C are representative cross-sectional views of successive axial sections of the well system, in which the packer assembly is set in the tubular string.
Figure 9B:
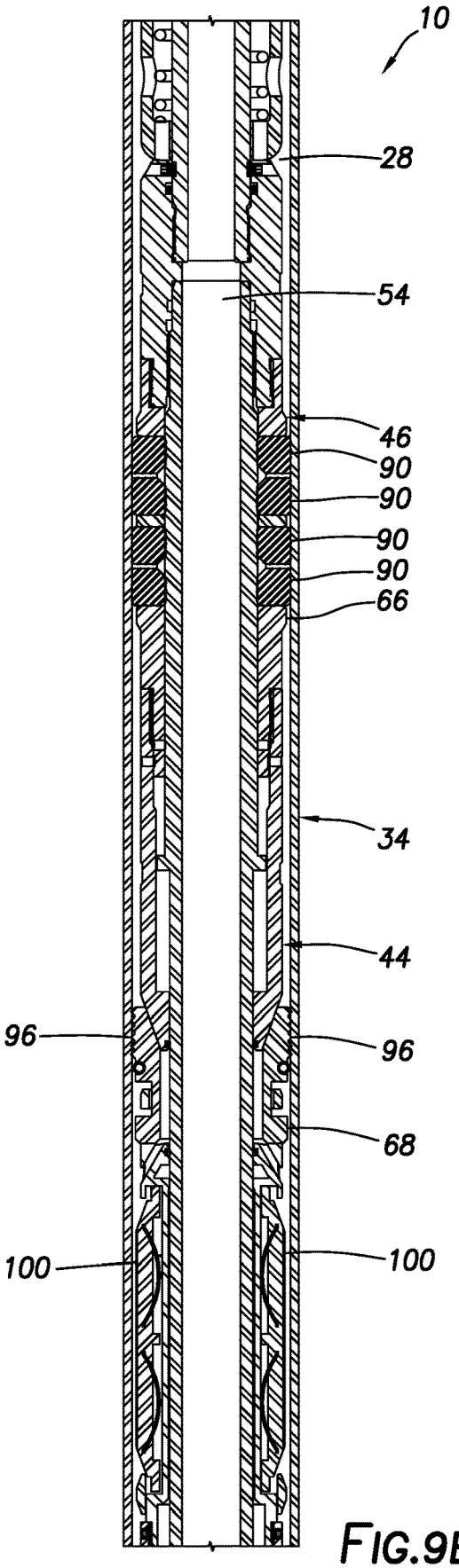
Figure 9C:
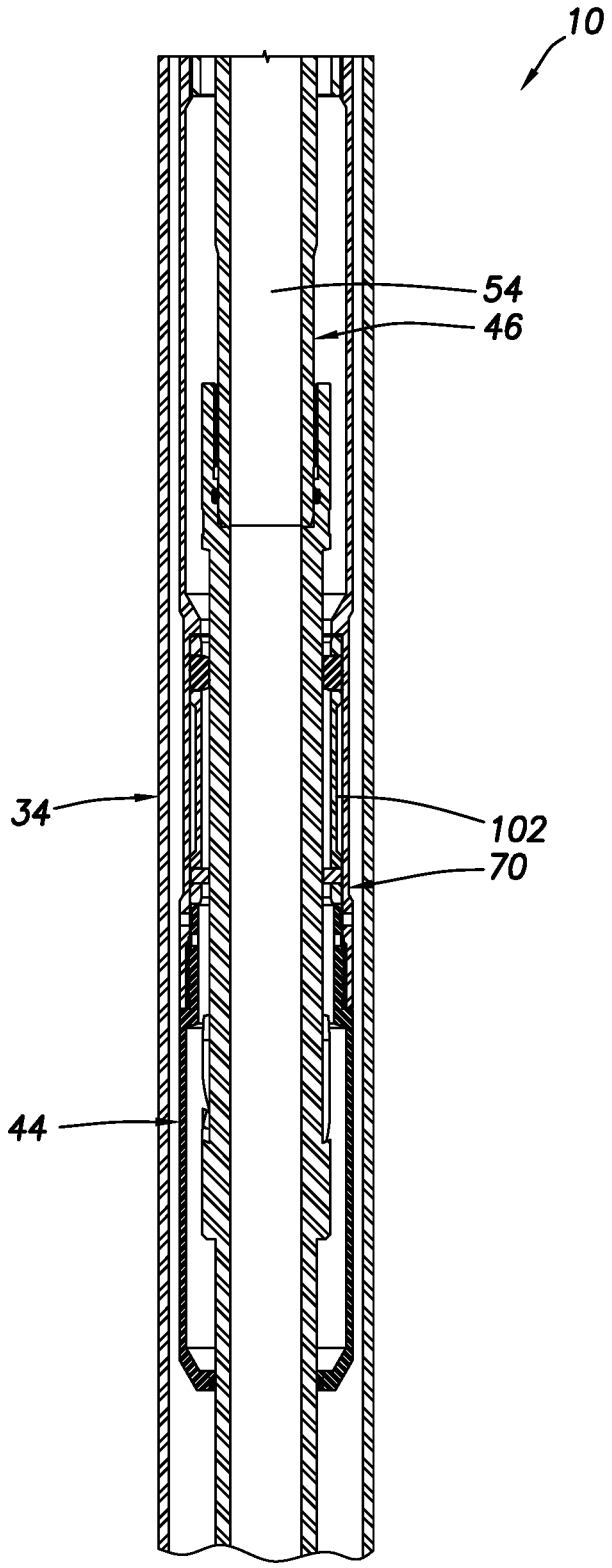

In FIGS. 9A-C, the packer assembly 46 is set in the tubular string 34 between the downhole valves 40*a,b*. In this example, the packer assembly 46 can be set by alternately displacing the packer assembly upward and downward (e.g., by raising and lowering the tubing string 12 from the surface) to operate the J-slot ratchet device 102 of the setting controller 70 to a position in which a subsequent downward displacement of packer assembly will cause the slips 96 to extend outwardly and grip the interior surface of the tubular string 34. Further weight applied to the packer assembly 46 (such as, by slacking off on the tubing string 12 at surface) will cause the seal elements 90 to be longitudinally compressed, so that they extend outward and sealingly engage the interior surface of the tubular string 34, thereby sealing off the annulus 28 between the BHA 44 and the tubular string 34.

With the packer assembly 46 set in the tubular string 34, the packer assembly can be tested to ensure its functionality. For example, the packer assembly 46 can be pressure tested by applying increased pressure to the annulus 28 and/or the flow passage 54 to determine whether the seal elements 90 are effectively sealing off the annulus 28, and whether the slips 96 are securing the BHA 44 against longitudinal displacement.

Figure 10:
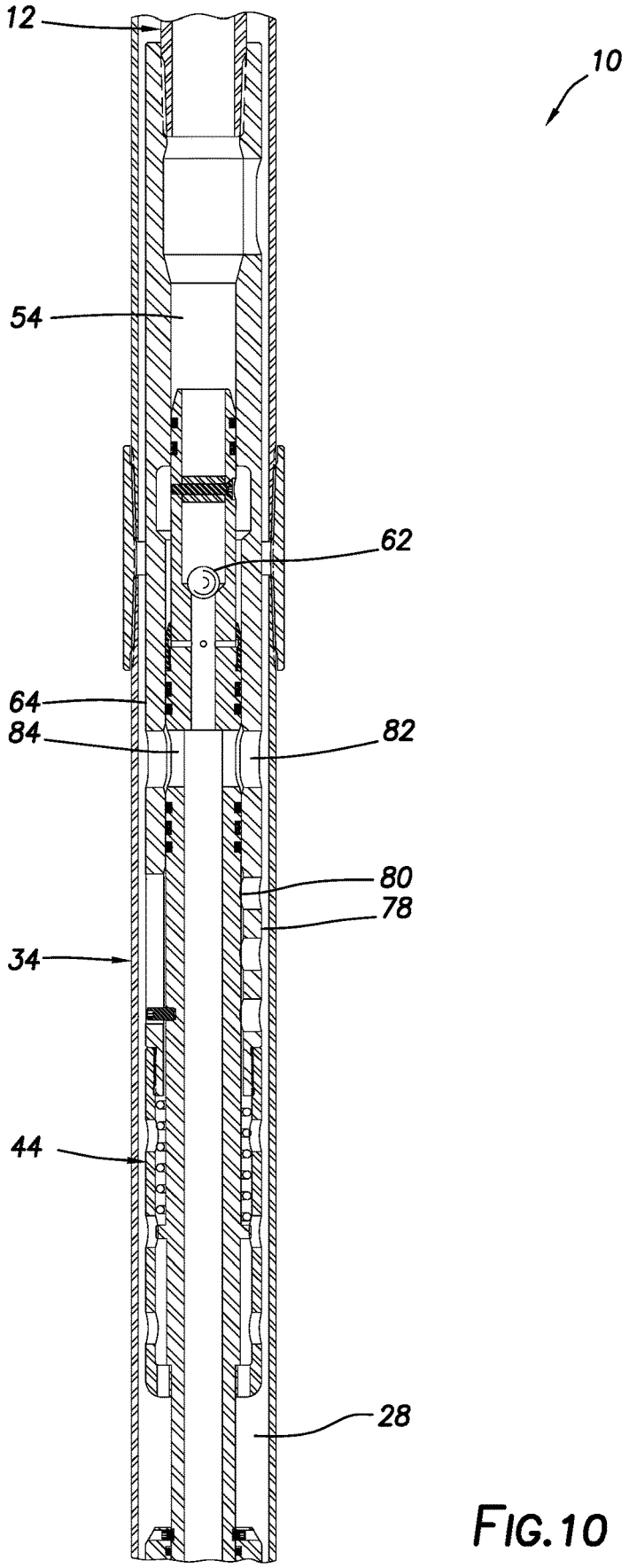
FIG. 10 is a representative cross-sectional view of a section of the well system, in which the unloader valve is opened.

In FIG. 10, increased pressure is applied to the annulus 28, and the unloader valve 64 is opened by raising the tubing string 12, thereby displacing the outer housing 78 upward relative to the inner mandrel 80 and aligning the ports 82, 84. Fluid communication is now permitted between the interior and exterior of the packer assembly 46 (between the flow passage 54 and the annulus 28 in the well system 10) longitudinally between the check valve 62 and the packer 66.

With the unloader valve 64 open, the increased pressure applied to the annulus 28 is transmitted to the flow passage 54 below the check valve 62. A pressure drop may be detected at surface as an indication that the unloader valve 64 is open.

Figure 11A:
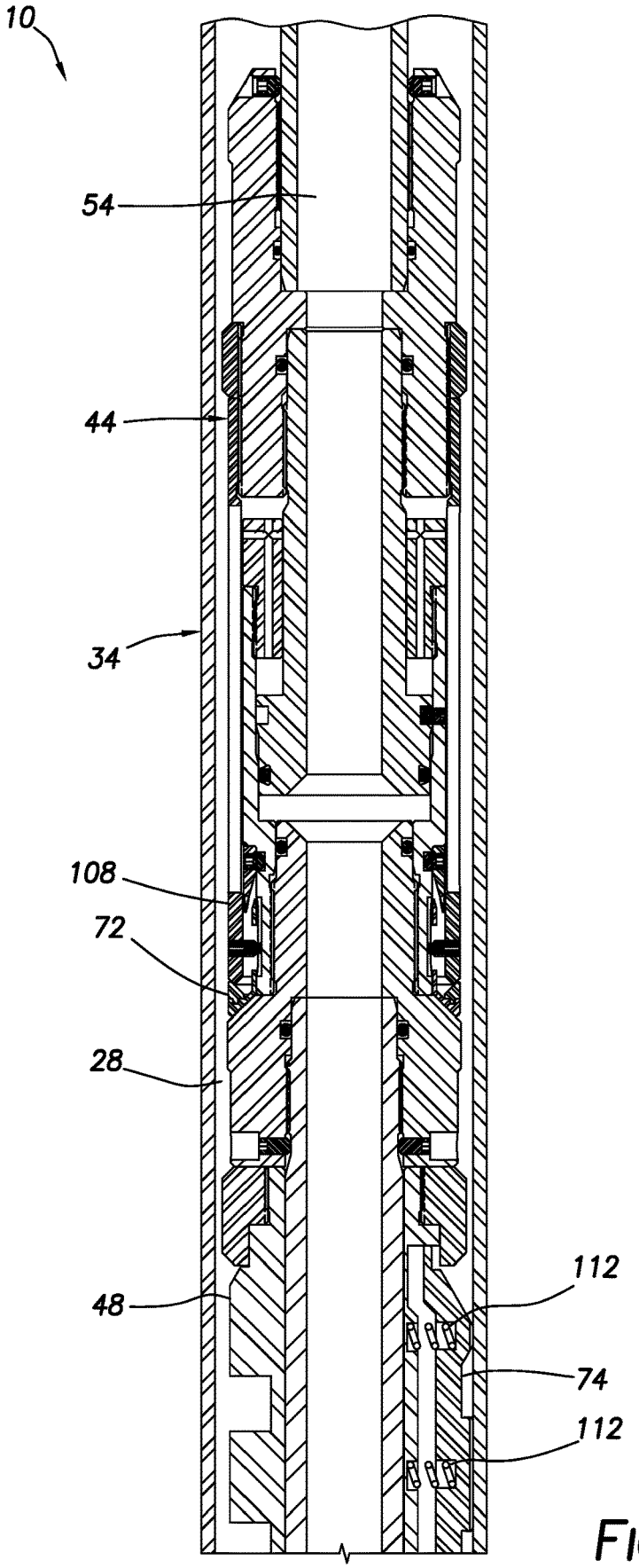
FIGS. 11A & B are representative cross-sectional views of successive axial sections of the well system, in which a bypass valve of the shifting tool is opened.
Figure 11B:
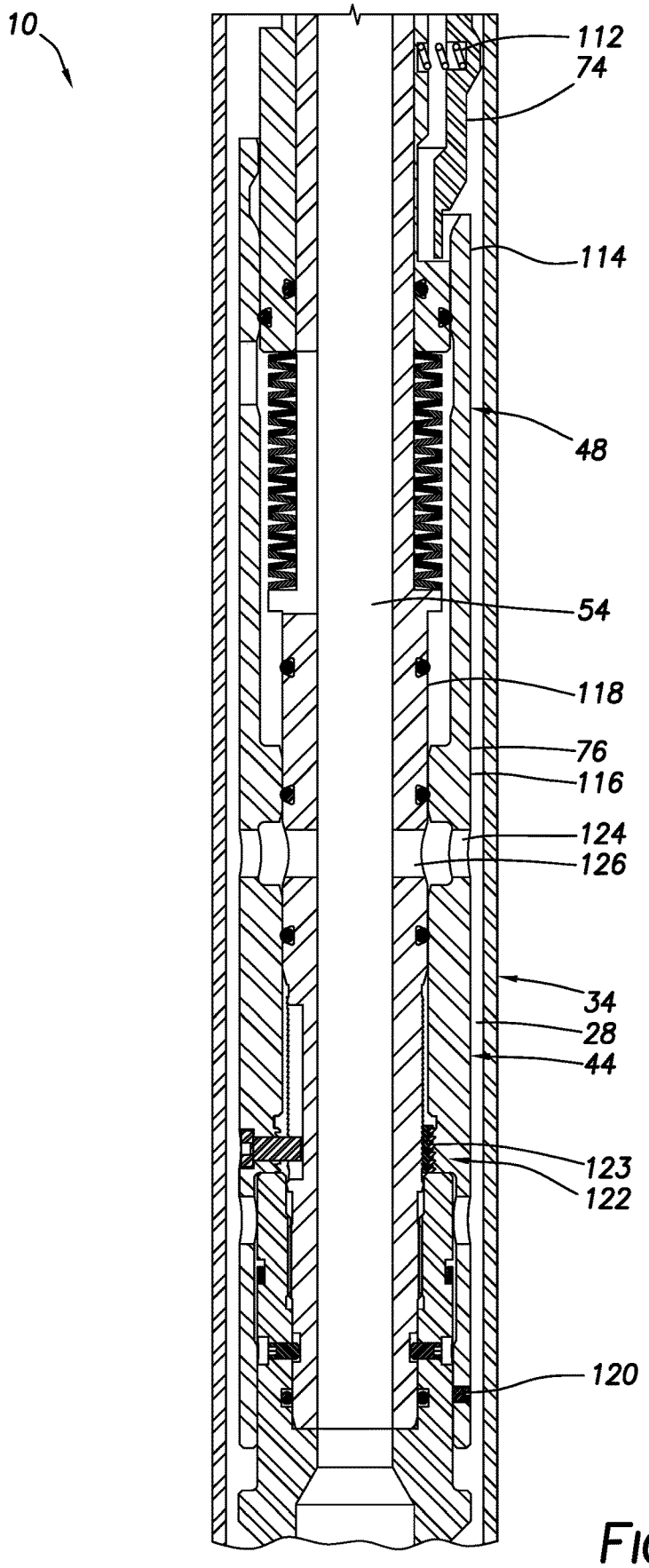

In FIGS. 11A & B, the pressure applied to the annulus 28 and to the flow passage 54 below the check valve 62 is transmitted to an interior of the shifting tool 48. A pressure differential from the interior to the exterior of the shifting tool 48 (e.g., from the flow passage 54 to the annulus 28 in the well system 10) is increased to a predetermined level, at which point the shear member 120 shears and the outer sleeve 116 is displaced downward relative to the inner mandrel 118.

The ports 124, 126 are now aligned and fluid communication is permitted between the interior and the exterior of the shifting tool 48 (e.g., between the flow passage 54 and the annulus 28 in the well system 10). The ratchet device 122 prevents the bypass valve 76 from closing after it has been opened. Note that pressures in the annulus 28 on opposite sides of the packer 66 are now equalized, since the flow passage 54 is now in communication with the annulus on opposite sides of the packer.

When the outer sleeve 116 displaces downward, the retainer 114 also displaces downward relative to the keys 74. The keys 74 are now biased to displace outward by the springs 112, and the keys slidingly contact the interior surface of the tubular string 34 as depicted in FIGS. 11A & B.

In examples in which the retainer 114 and the outer sleeve 116 are separate components, the retainer may be displaced downward relative to the keys 74 prior to the outer sleeve 116 being displaced downward. A pressure differential from the interior to the exterior of the shifting tool 48 (e.g., from the flow passage 54 to the annulus 28 in the well system 10) can be increased to a predetermined level, at which point a shear member (not shown) releasably securing the retainer 114 can shear to allow the retainer to displace downward, and the pressure differential can be further increased to another predetermined level, at which point the shear member 120 can shear to allow the outer sleeve 116 to displace downward to open the bypass valve 76.

Figure 12A:
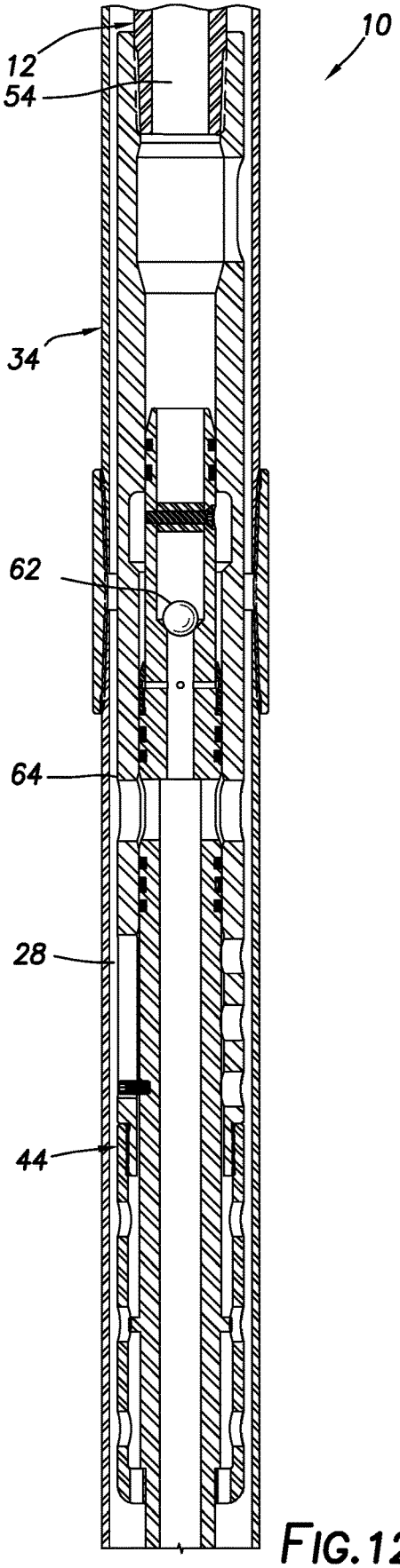
FIGS. 12A-C are representative cross-sectional views of successive axial sections of the well system, in which the packer assembly is unset.
Figure 12B:
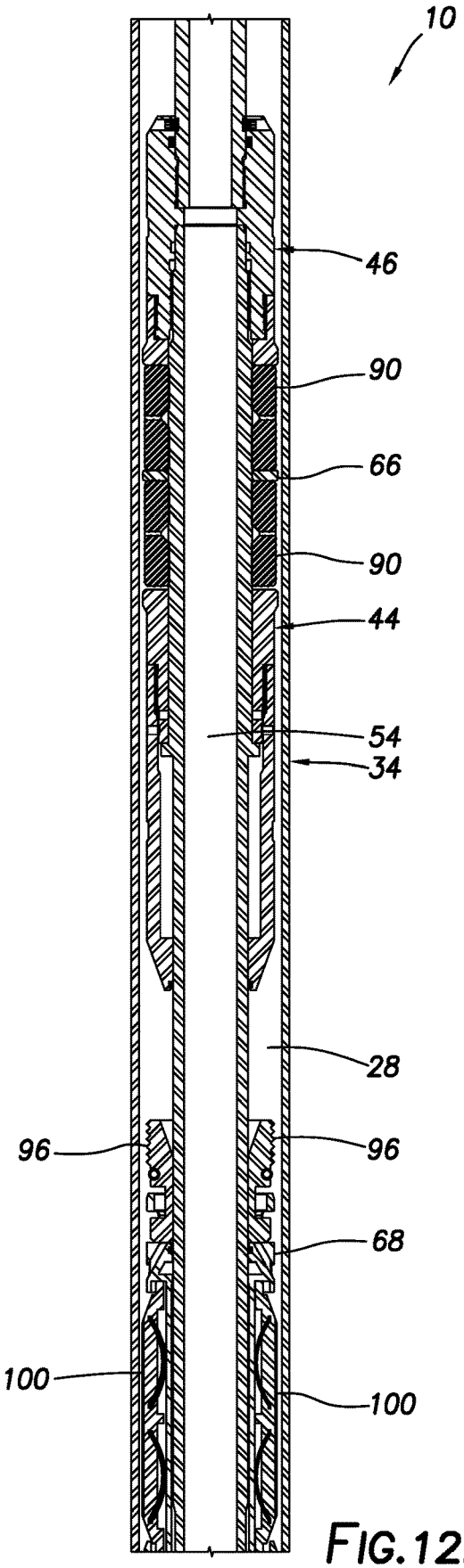
Figure 12C:
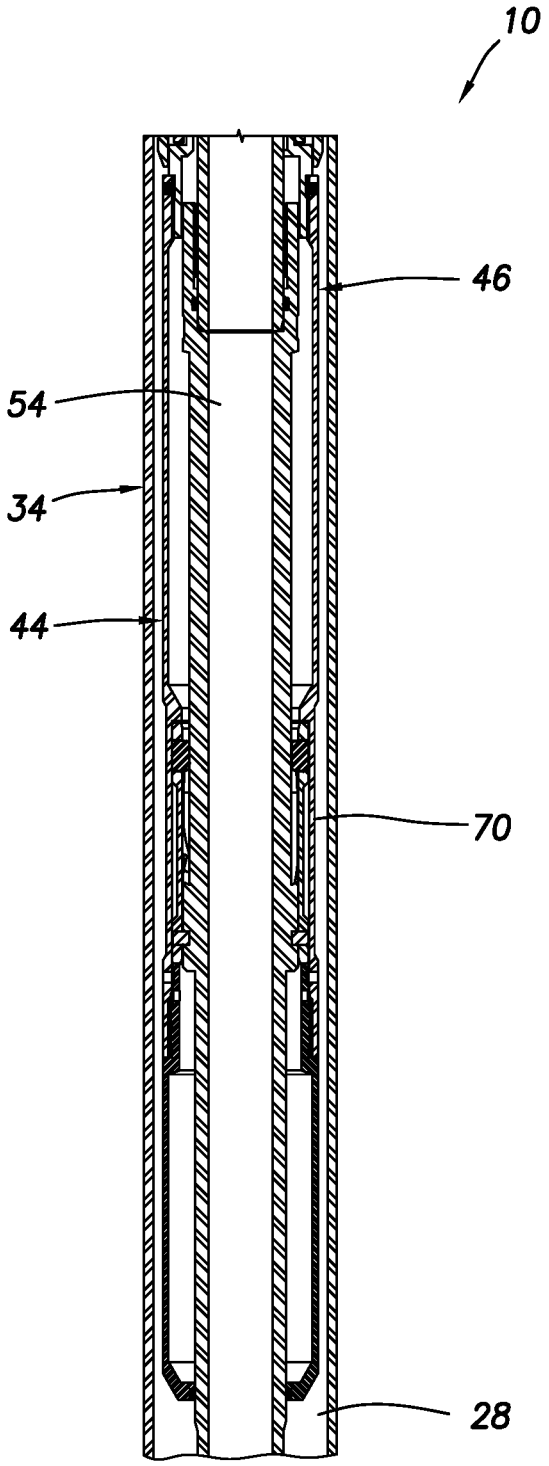

In FIGS. 12A-C, the packer assembly 46 is unset by pulling tension in the tubing string 12 (e.g., by picking up on the tubing string at the surface). The seal elements 90 and slips 96 are, thus, retracted and disengaged from the interior surface of the tubular string 34. The unloader valve 64 remains open.

Figure 13A:
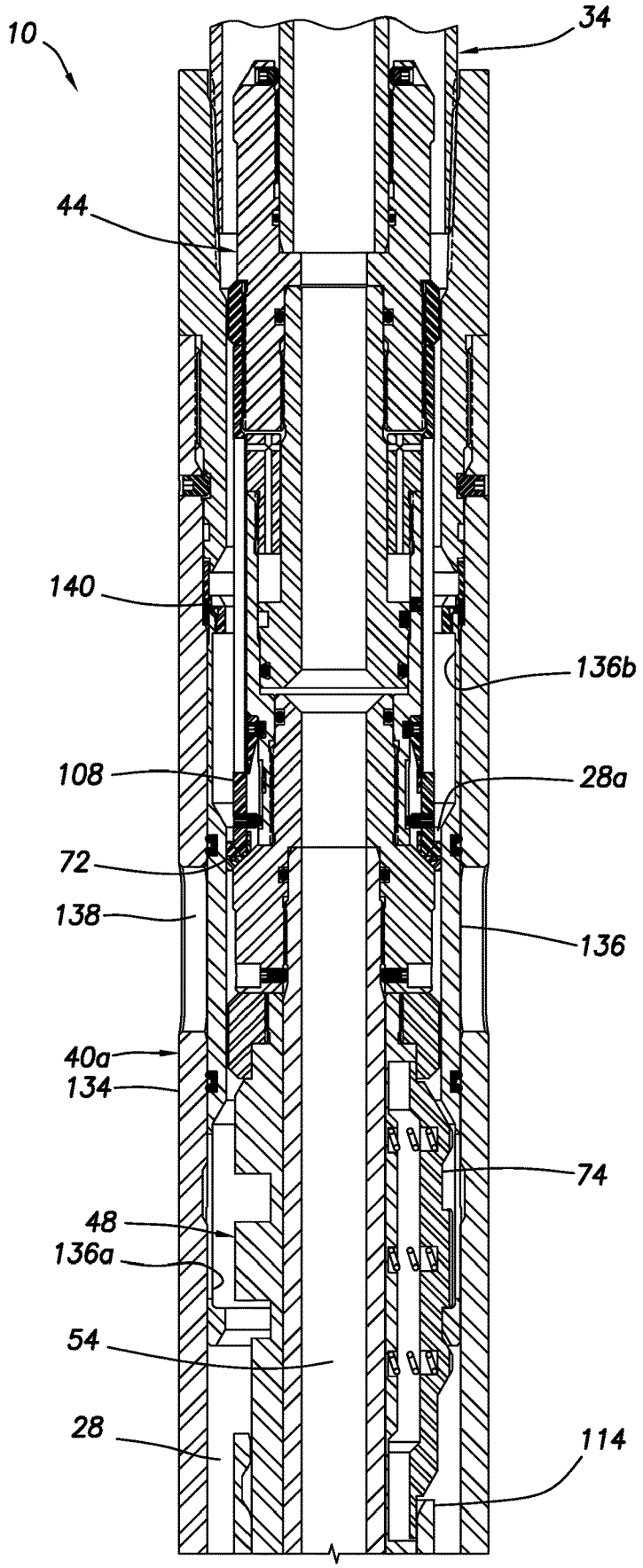
FIGS. 13A & B are representative cross-sectional views of successive axial sections of the well system, in which keys of the shifting tool are engaged with a profile in the downhole valve and an annular flow restrictor of the shifting tool is actuated.
Figure 13B:
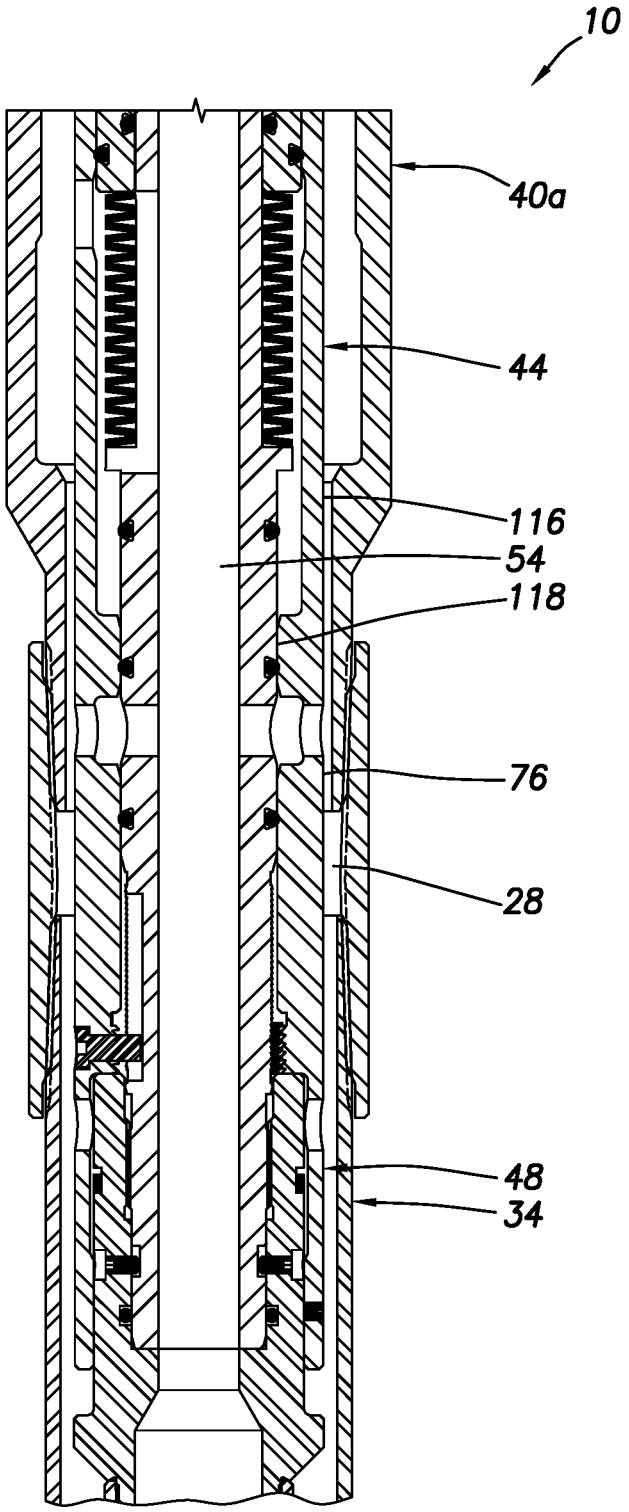

In FIGS. 13A & B, the BHA 44 is displaced downwardly in the tubular string 34 (e.g., by lowering the tubing string 12 at the surface). Eventually, the keys 74 will engage the profile 136*a* in the closure member 136 of the downhole valve 40*a*, so that the shifting tool 48 cannot displace further downward unless the closure member 136 also displaces with the shifting tool.

Note that the flow restrictor 72 is depicted in FIGS. 13A & B in its extended configuration, so that a flow area through the annulus 28 external to the shifting tool 48 is decreased, thereby creating a restriction 28*a* to flow through the annulus 28 at the flow restrictor 72. This radial expansion can be due to longitudinal compression of the flow restrictor 72 resulting from downward displacement of the outer sleeve 108 as the shifting tool 48 displaces downward after the keys 74 have engaged the closure member 136.

In this example, the flow restrictor 72 does not seal against an interior surface of the closure member 136. Instead, the flow restrictor 72 restricts flow through the annulus 28, so that a pressure differential can be produced due to such restricted flow through the annulus across the flow restrictor. In other examples, the flow restrictor 72 could sealingly contact the closure member 136 or another portion of the downhole valve 40*a*, if desired.

Figure 14:
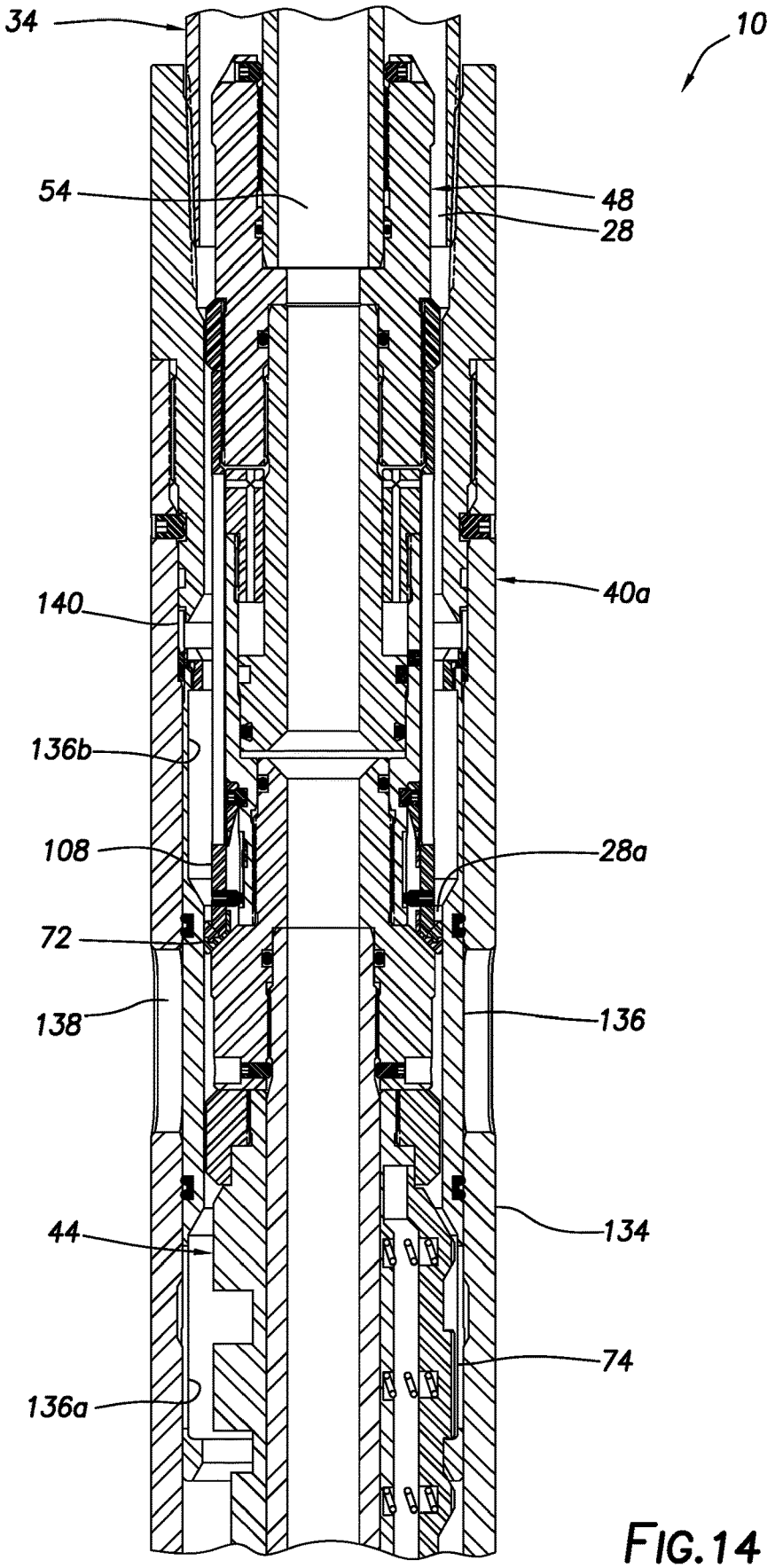
FIG. 14 is a representative cross-sectional view of a section of the well system, in which a sleeve of the downhole valve is displaced somewhat with the shifting tool.

In FIG. 14, a sufficient downwardly directed force has been transmitted to the closure member 136 from the shifting tool keys 74 to shear the shear member 140, thereby permitting the closure member 136 to displace downward with the shifting tool 48. As depicted in FIG. 14, the closure member 136 has displaced downward somewhat relative to the outer housing 134 after the shear member 140 has been sheared.

If not previously extended outward, the flow restrictor 72 is now extended radially outward due to the compressive force applied to the shifting tool 48 to shear the shear member 140. In some situations (for example, if the wellbore 14 is highly deviated or horizontal at the downhole valve 40*a*), the weight of the tubing string 12 may not be enough to overcome friction between the tubing string 12 and the tubular string 34 in order to downwardly displace the BHA 44, shear the shear member 140 and then downwardly displace the closure member 136 to its open position.

In such situations, a pressure differential can be created across the extended flow restrictor 72 to apply an increased downwardly directed longitudinal force to the shifting tool 48. Increased pressure applied above the BHA 44 can also be used to increase the longitudinal force applied downwardly to the BHA.

Figure 15:
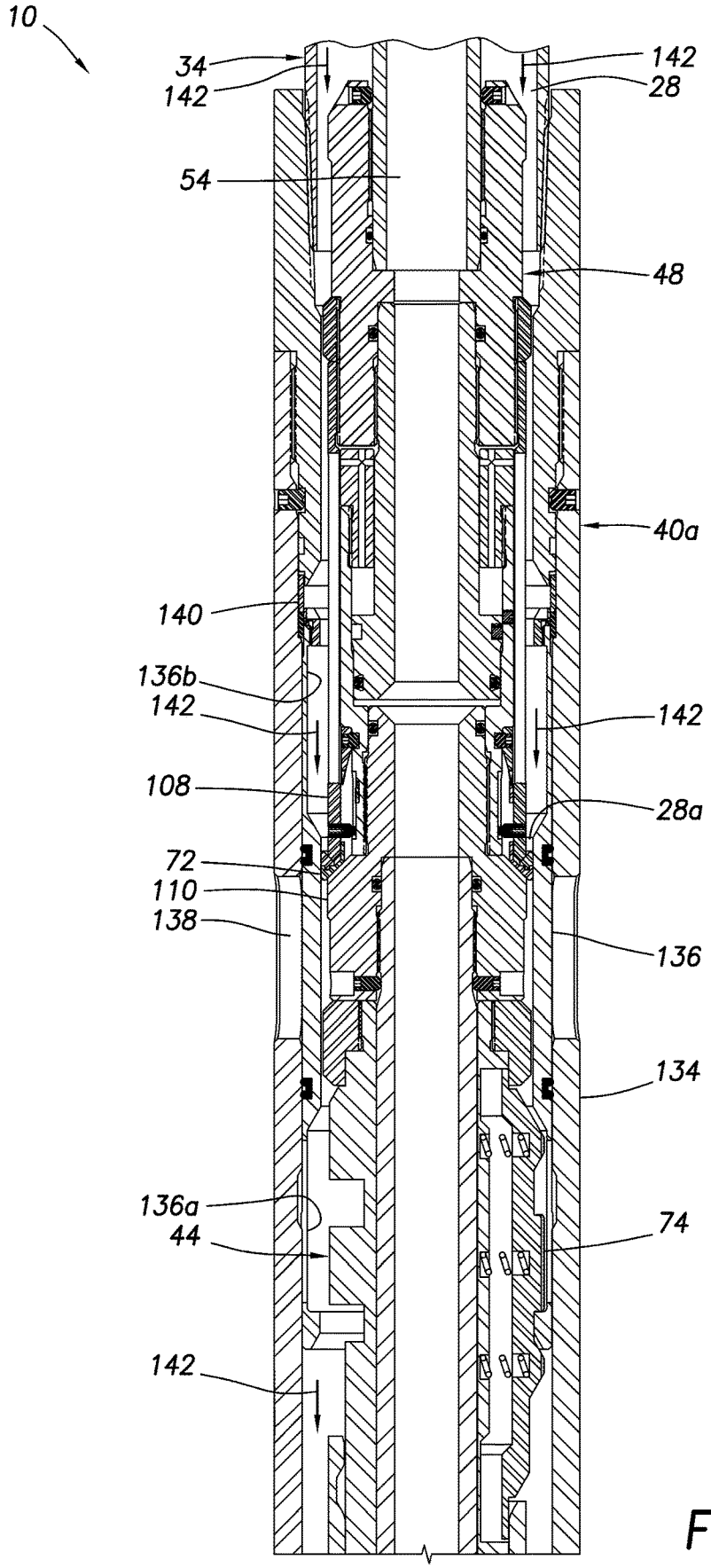
FIG. 15 is a representative cross-sectional view of a section of the well system, in which flow across the annular flow restrictor results in a pressure differential across the sleeve.

In FIG. 15, a fluid 142 is flowed downward through the annulus 28 to the BHA 44. Flow of the fluid 142 through the annulus 28 is substantially restricted by the outwardly extended flow restrictor 72, so that a pressure differential is created across the flow restrictor in the annulus. This pressure differential from above to below the flow restrictor 72 produces an increased longitudinally downwardly directed force applied to the shifting tool 48 and transmitted via the keys 74 to the closure member 136.

Figure 16A:
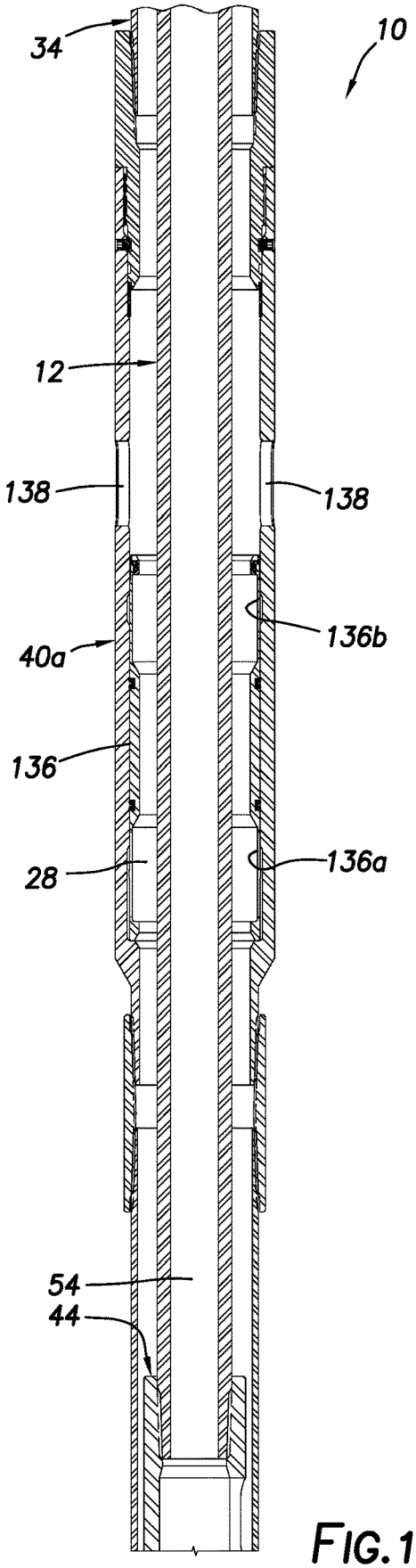
FIGS. 16A & B are representative cross-sectional views of successive axial sections of the well system, in which the downhole valve is opened.
Figure 16B:
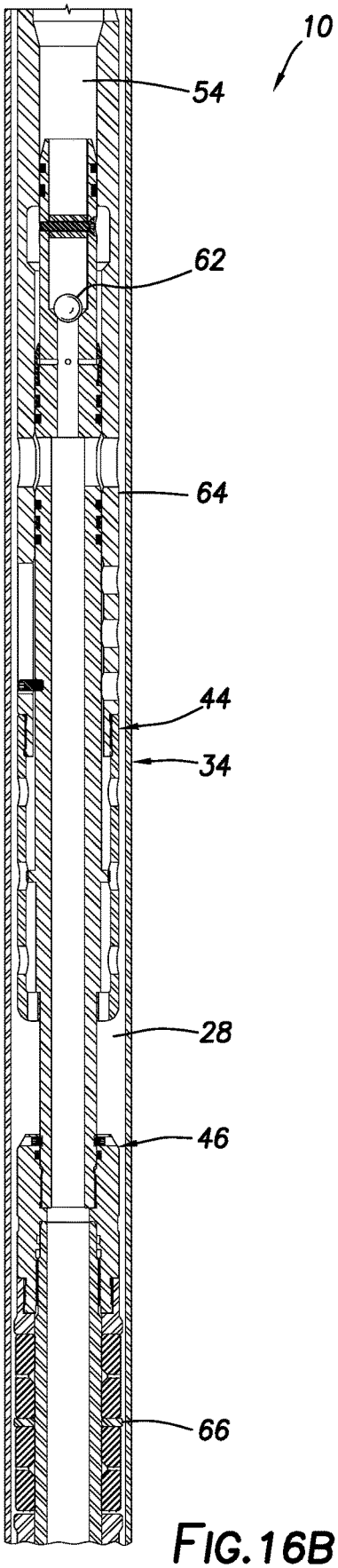

In FIGS. 16A & B, the closure member 136 is displaced downward to its open position, so that the ports 138 are now unblocked and fluid communication between the interior and exterior of the downhole valve 40*a* is permitted. Note that a sufficient downwardly directed force applied to the shifting tool 48 to cause the shear member 140 to shear, and to displace the closure member 136 to its open position, can be any combination of tubing string 12 weight applied to the BHA 44, force due to the pressure differential created across the flow restrictor 72 by flow of the fluid 142 through the annulus 28, and force due to the pressure applied above the BHA 44.

The packer assembly 46 is now positioned below the open downhole valve 40*a*. With the packer assembly 46 in this position, the tubing string 12 can be reciprocated upward and downward in the tubular string 34 to actuate the setting controller 70 to a position in which subsequent downward displacement of the packer assembly will cause it to be set in the tubular string below the downhole valve 40*a*.

Figure 17A:
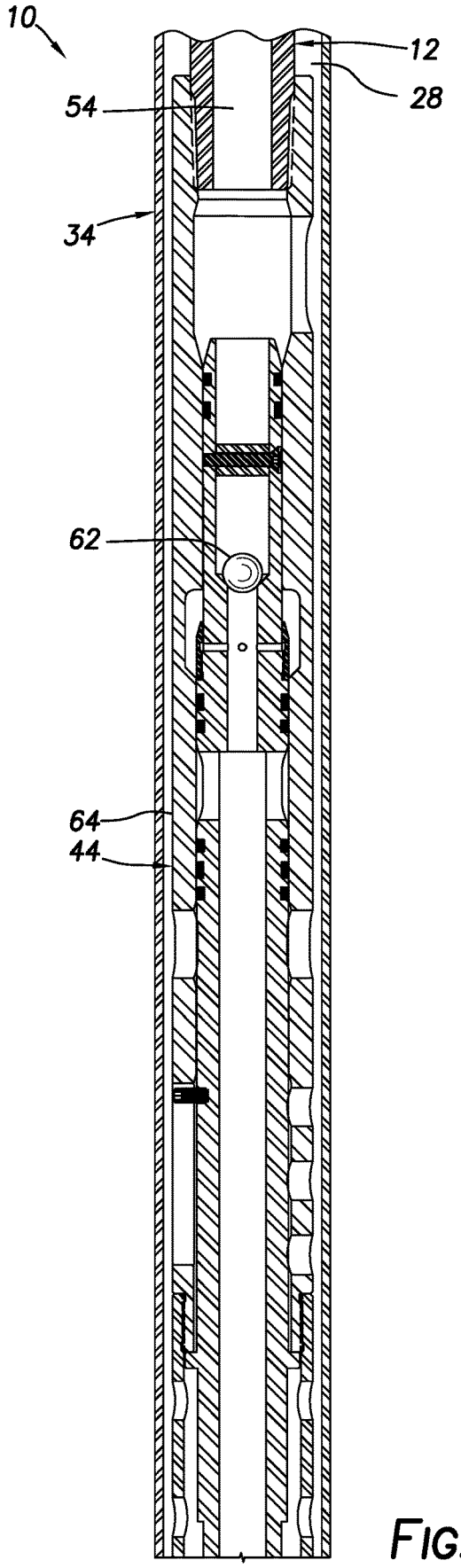
FIGS. 17A-C are representative cross-sectional views of successive axial sections of the well system, in which the packer assembly is set.
Figure 17B:
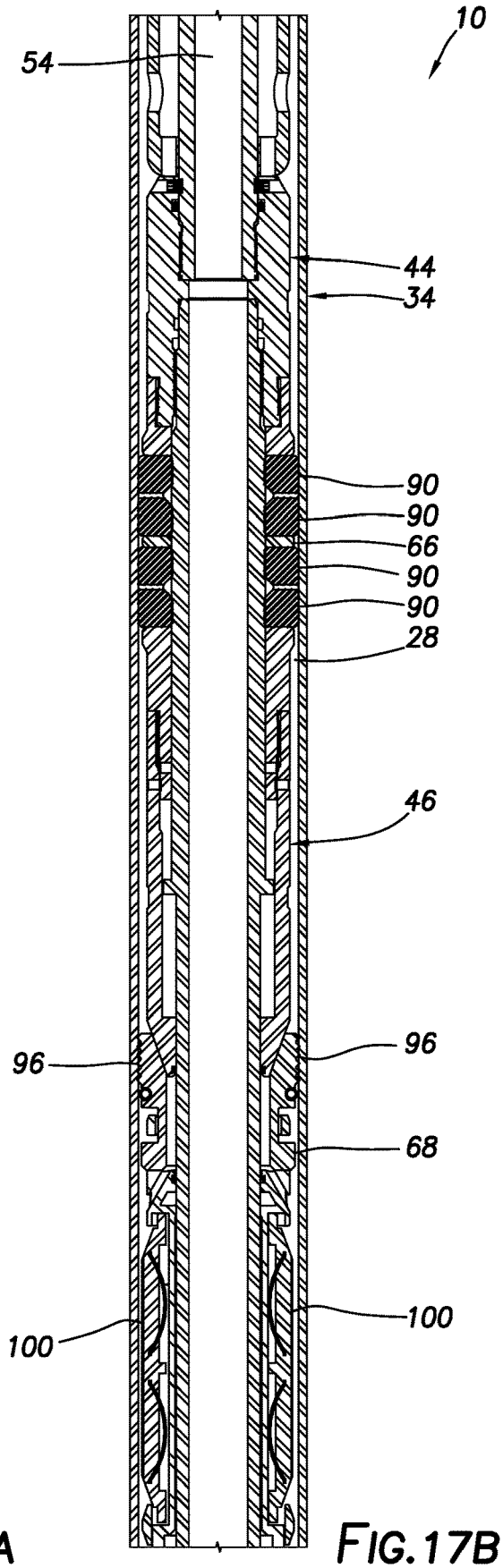
Figure 17C:
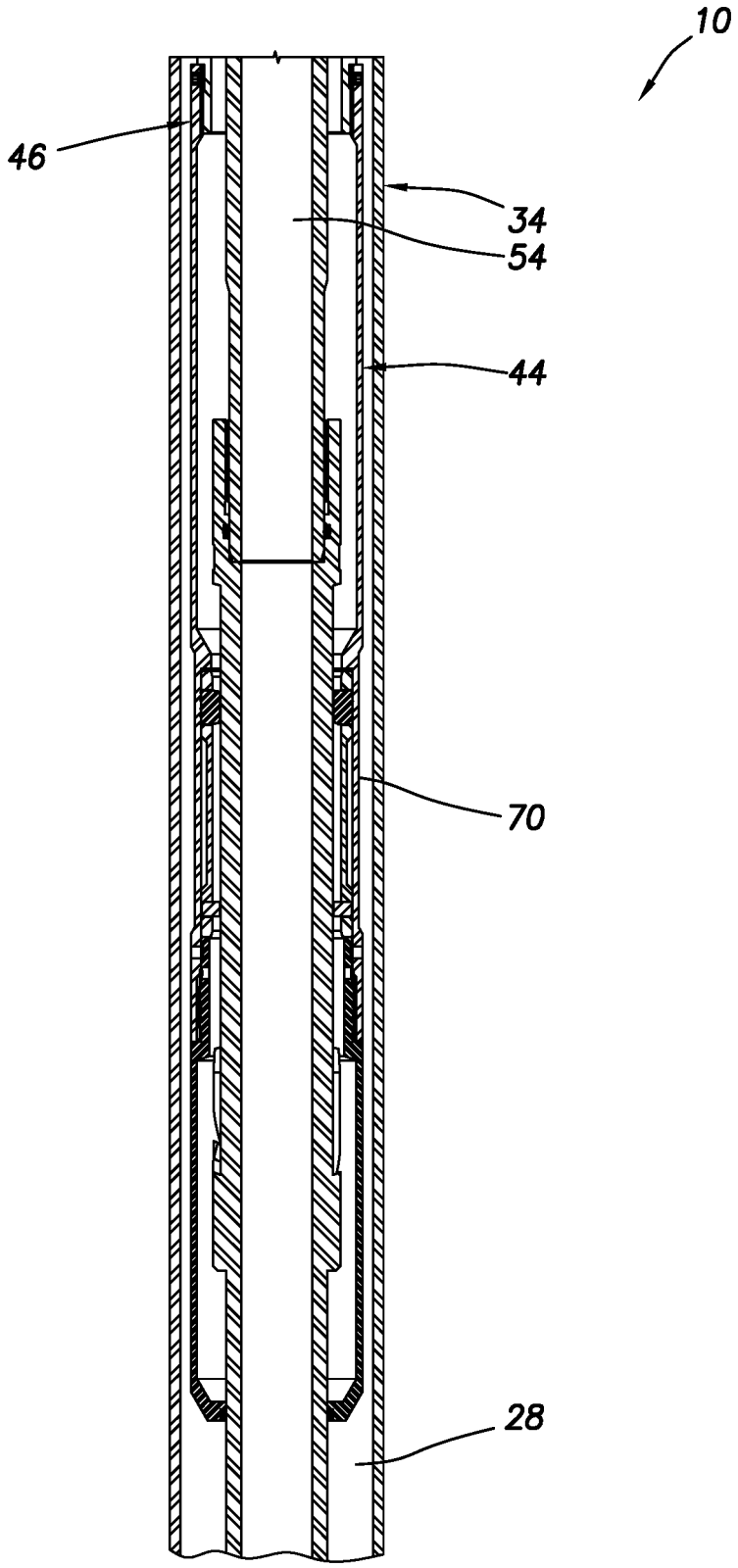

In FIGS. 17A & B, the packer assembly 46 is set in the tubular string 34 below the open downhole valve 40*a*. The seal elements 90 sealingly engage the interior surface of the tubular string 34 and the slips 96 grippingly engage the interior surface of the tubular string 34. The unloader valve 64 is closed.

In this configuration, the zone 36*b* (see FIGS. 2A & B) can be fractured by flowing fluid (such as, slurries, gels, breakers, spacers, acids, buffers, conformance agents, etc.) through the annulus 28, and outward though the open downhole valve 40*a* above the set packer assembly 46. The check valve 62, the seals 86 (see FIG. 4A) and the seal elements 90 prevent these fluids from flowing downward past the packer assembly 46 via the annulus 28 or flow passage 54.

Figure 18:
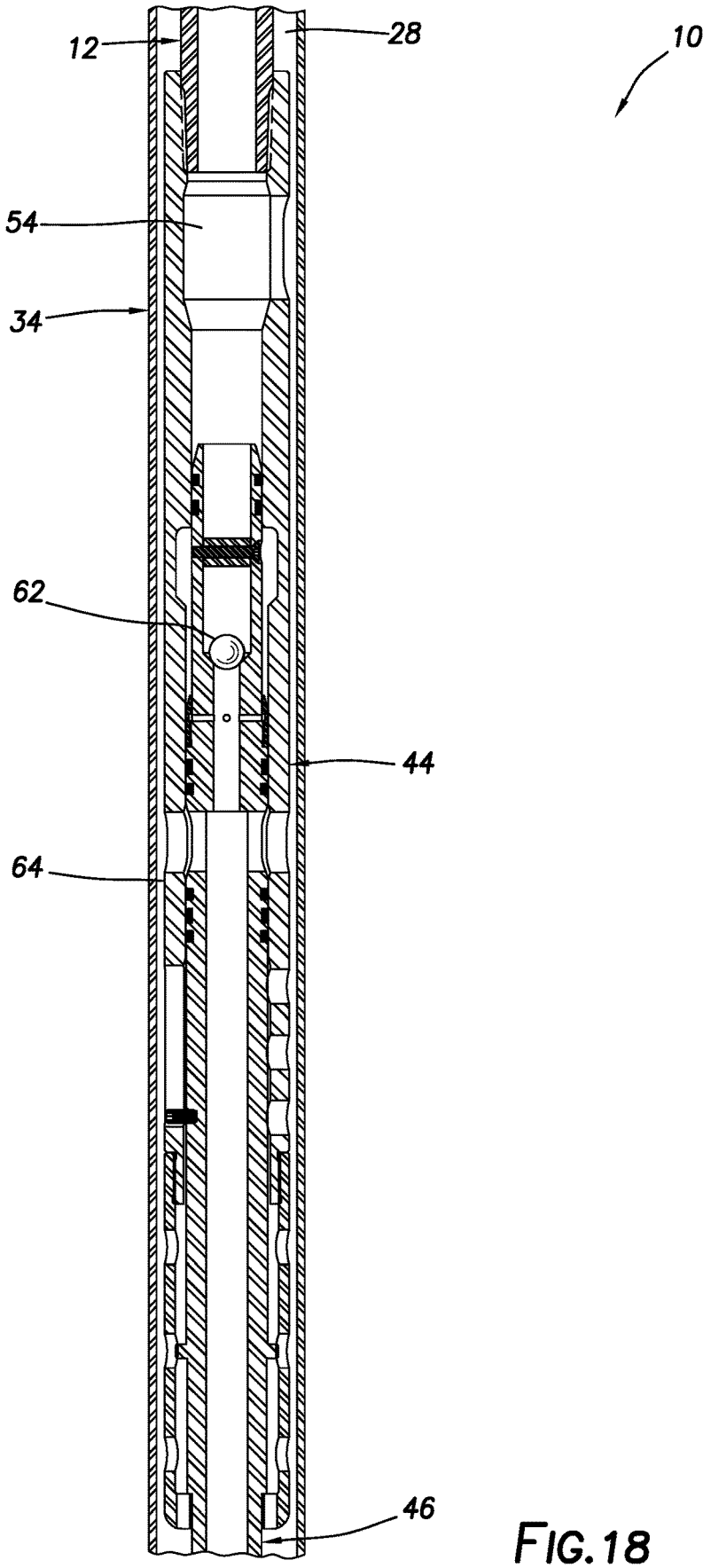
FIG. 18 is a representative cross-sectional view of a section of the well system, in which the unloader valve is opened prior to unsetting the packer assembly.

In FIG. 18, the packer assembly 46 is unset after the fracturing operation. To unset the packer assembly 46, tension is applied to the packer assembly by raising the tubing string 12 from surface. The unloader valve 64 opens, and then the seal elements 90 and the slips 96 retract out of engagement with the interior surface of the tubular string 34. The tension applied to the packer assembly 46 is also transmitted to the outer sleeve 108 (see FIG. 15), displacing it upward relative to the housing 110, and thereby allowing the flow restrictor 72 to retract radially inward.

Figure 19:
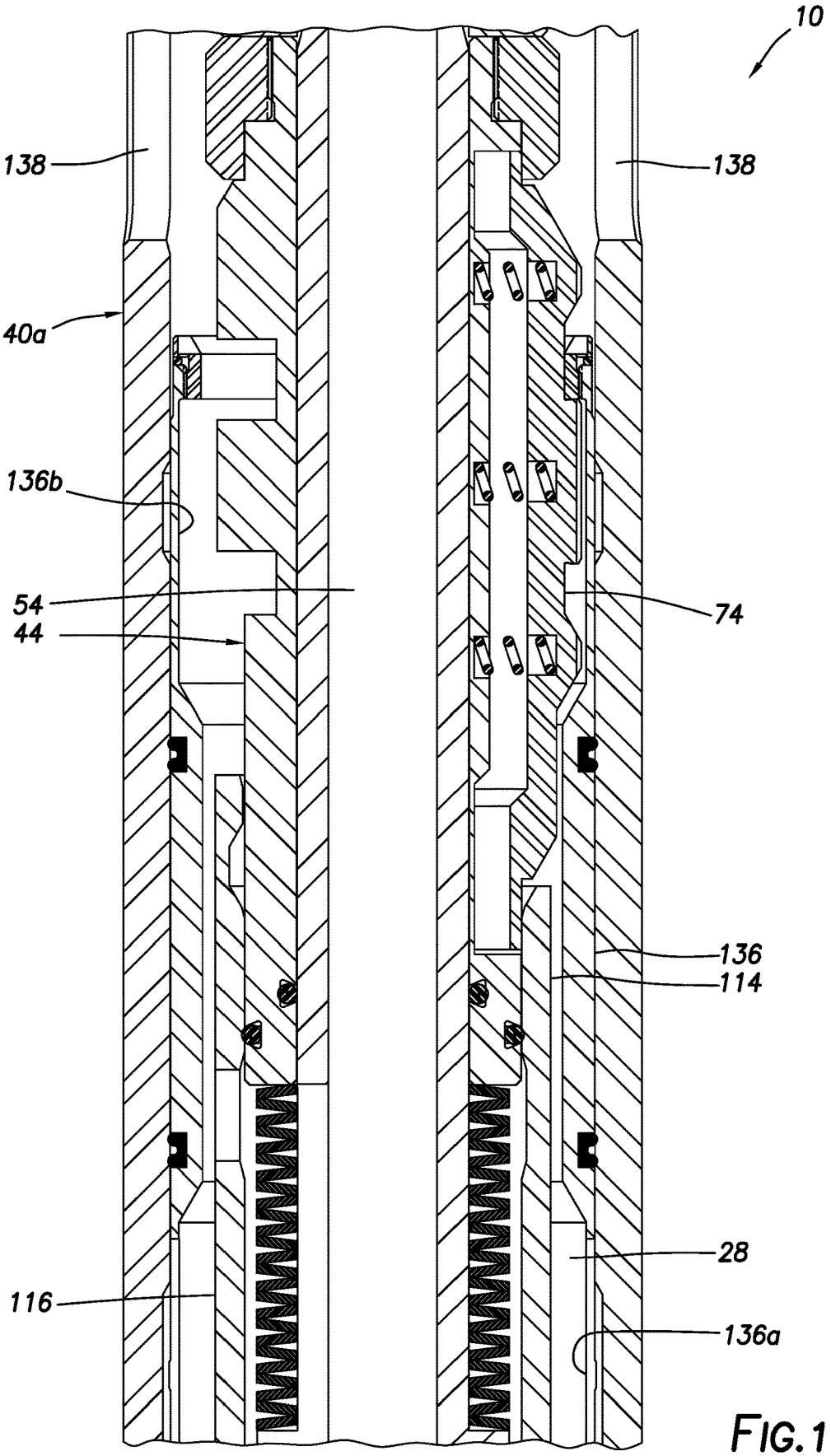
FIG. 19 is a representative cross-sectional view of a section of the well system, in which the shifting tool keys are engaged with a profile in the sleeve.

In FIG. 19, the tubing string 12 has been raised sufficiently far in the tubular string 34 for the shifting tool 48 to again engage the downhole valve 40*a*. Specifically, the keys 74 now are engaged with the profile 136*b* in the closure member 136. Further upward displacement of the tubing string 12 and BHA 44 will cause the closure member 136 to also displace upward to its closed position.

Figure 20:
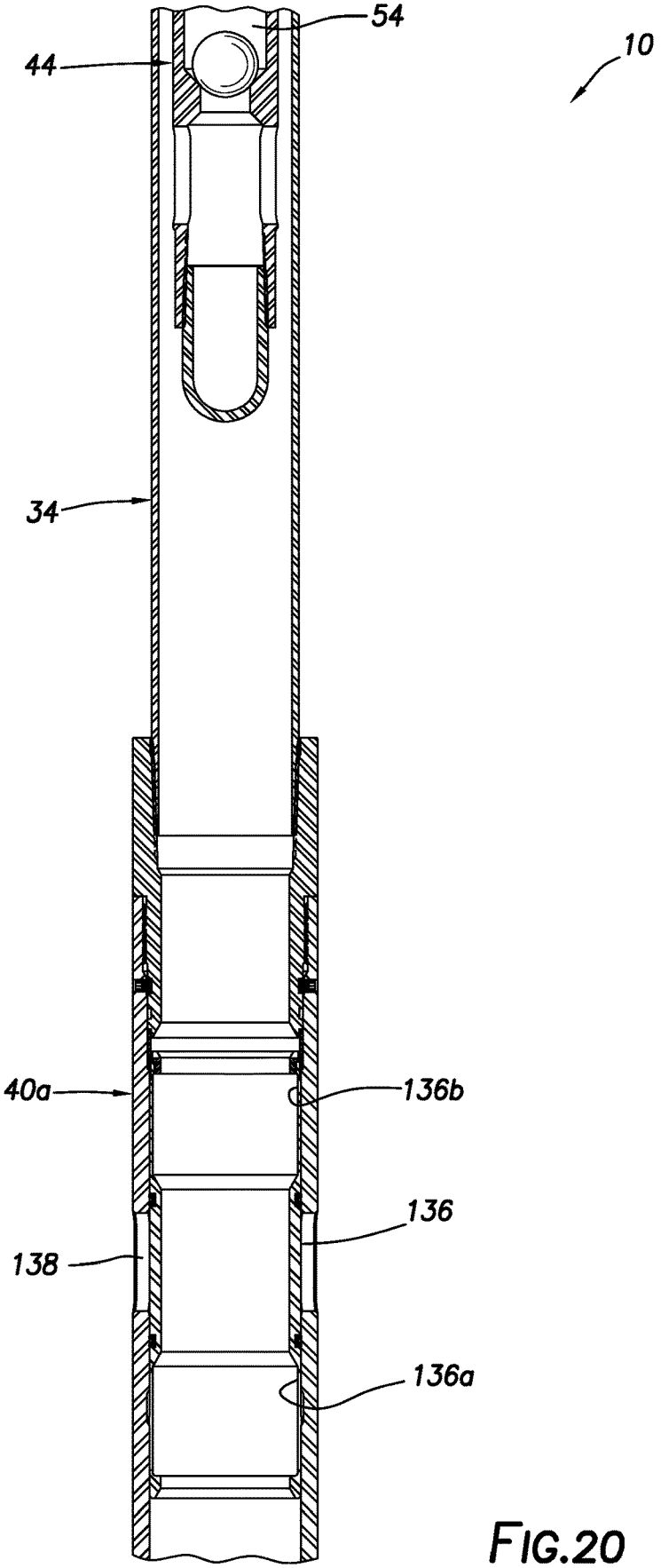
FIG. 20 is a representative cross-sectional view of a section of the well system, in which the sleeve is shifted to a closed position.

In FIG. 20, the BHA 44 has been raised to a position above the downhole valve 40*a*. The closure member 136 has been displaced upward to its closed position, so that fluid communication is now prevented between the interior and the exterior of the downhole valve 40*a*. The fractured zone 36*b* exterior to the downhole valve 40*a* will now be unaffected by pressures and fluids in the tubular string 34 in subsequent operations.

Figure 21:
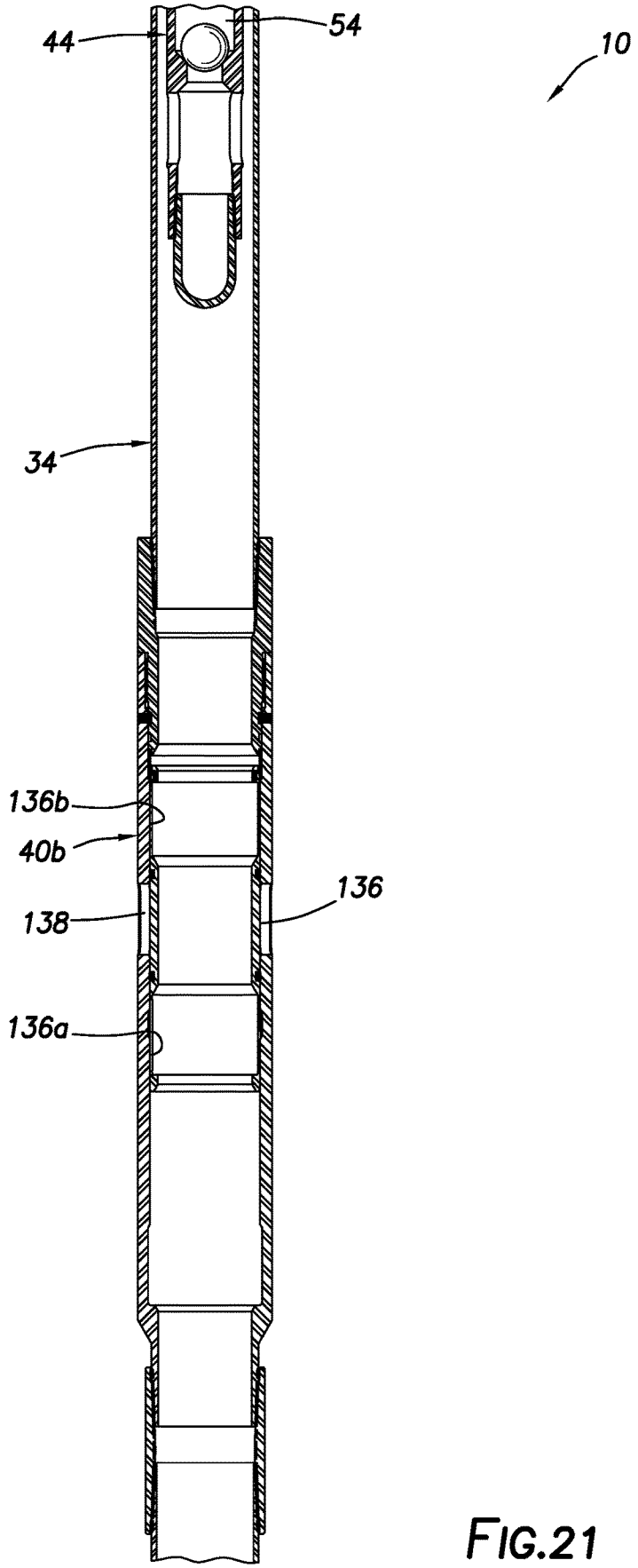
FIG. 21 is a representative cross-sectional view of a section of the well system, in which the bottom hole assembly is positioned for operating another downhole valve.

In FIG. 21, the BHA 44 has been raised further in the tubular string 34, so that it is now above the closed downhole valve 40*b*. The BHA 44 is positioned longitudinally between the closed downhole valves 40*b,c* (see FIGS. 2A & B).

The BHA 44 is now in a similar position with respect to the downhole valve 40*b* as it was with respect to the downhole valve 40*a* as depicted in FIG. 8. The steps depicted in FIGS. 9A-20 can now be repeated for the downhole valve 40*b* and corresponding zone 36*c*.

These steps can include opening the downhole valve 40*b* by downwardly displacing the BHA 44 until the keys 74 engage the sleeve profile 136*a*, applying a sufficient downward force to displace the closure member 136 to its open position, setting the packer assembly 46 below the open downhole valve 40*b*, fracturing the zone 36*c*, unsetting the packer assembly 46, displacing the BHA 44 upward through the downhole valve 40*b* until the keys 74 engage the sleeve profile 136*b*, and displacing the closure member 136 to its closed position. These steps can be performed for each of the downhole valves 40*a-e* in succession, in order to fracture each of the respective zones 36*b-f* in succession.

Figure 22:
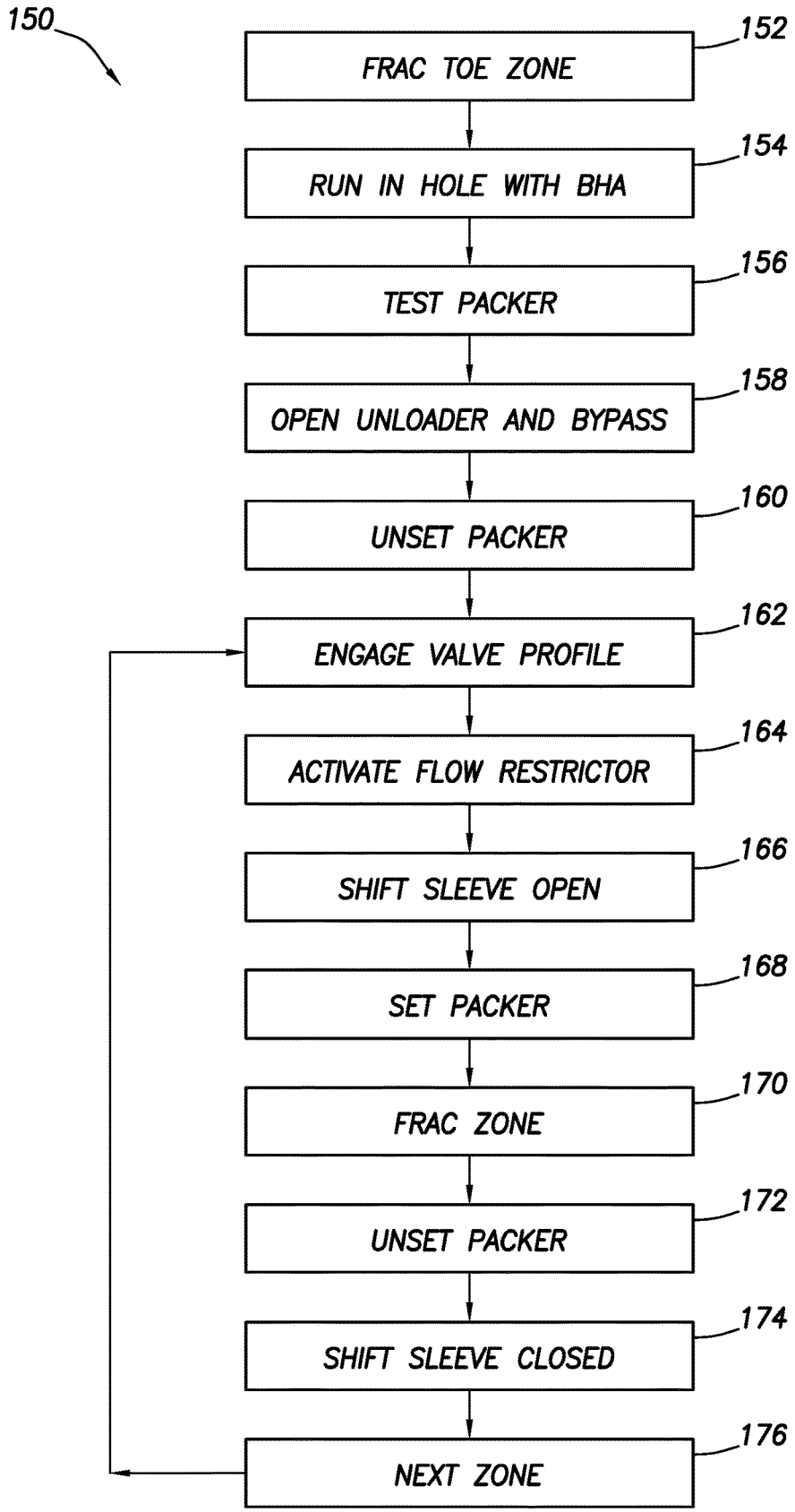
FIG. 22 is a representative flow chart for an example of a method for operating one or more downhole valves.

Referring additionally now to FIG. 22, a representative flowchart is depicted for an example of a method 150 for operating downhole valves. The method 150 is described below as it may be performed with the well system 10 of FIGS. 1-2B and the BHA 44 of FIGS. 3A-D, but the method may be performed with other well systems or bottomhole assemblies in keeping with the scope of this disclosure.

In step 152, the downhole valve 38 is opened and the zone 36*a* is fractured. In some examples, the downhole valve 38 may be opened by applying increased pressure to the tubular string 34. The BHA 44 may or may not be present in the tubular string 34 when the downhole valve 38 is opened or when the zone 36*a* is fractured.

In step 154, the BHA 44 is conveyed into the tubular string 34. At this point, the BHA 44 may be positioned between the downhole valves 40*a,b* as depicted in FIG. 8.

In step 156, the packer assembly 46 is set in the tubular string 34 and is tested. This ensures that the packer assembly 46 is fully functional prior to subsequent fracturing operations (see FIGS. 9A-C).

In step 158, the unloader valve 64 is opened by picking up on the tubing string 12 (see FIG. 10). Increased pressure applied to the annulus 28 is thereby transmitted to the bypass valve 76, which opens when the pressure differential from the interior to the exterior of the shifting tool 48 reaches a predetermined level. Opening of the bypass valve 76 also causes the keys 74 to be released from the retainer 114, so that the keys are biased by the springs 112 to extend outward (see FIGS. 11A & B). In some examples, releasing of the keys 74 from the retainer 114 may be separate from opening of the bypass valve 76.

In step 160, the packer assembly 46 is unset by picking up on the tubing string 12 at the surface to apply tension to the BHA 44 (see FIGS. 12A-C).

In step 162, the shifting tool 48 engages the downhole valve 40*a*. Specifically, the keys 74 engage the profile 136*a* in the closure member 136 (see FIGS. 13A & B).

In step 164, the flow restrictor 72 is activated, so that it reduces a flow area through the annulus 28 and can increasingly restrict flow of the fluid 142 across the flow restrictor (see FIG. 14). The flow restrictor 72 extends outward in response to compression of the shifting tool 48 after the keys 74 have engaged the profile 136*a*, which causes the outer sleeve 108 to displace downward toward the flow restrictor.

Note that use of the flow restrictor 72 is optional, since in some situations the weight of the tubing string 12 can be sufficient to apply a downwardly directed force to the BHA 44 in order to shift the closure member 136 downward to its open position.

In step 166, the closure member 136 is shifted to its open position (see FIG. 15). A downwardly directed force is applied from the BHA 44 to the closure member 136 via the keys 74 to shear the shear member 140 and displace the closure member downward. This downwardly directed force may be a combination of forces due to the weight of the tubing string 12, flow of the fluid 142 through the annulus 28 past the extended flow restrictor 72, and pressure applied above the BHA 44.

In step 168, the packer assembly 46 is set in the tubular string 34 below the open downhole valve 40*a* (see FIGS. 16A-17C).

In step 170, the zone 36*b* is fractured by flowing fluids from the interior of the tubular string 34 and outward through the open downhole valve 40*a*.

In step 172, the packer assembly 46 is unset after the fracturing operation of step 170 (see FIG. 18) by applying an upwardly directed force to the packer assembly (e.g., by raising the tubing string 12 at the surface). The unloader valve 64 opens and equalizes pressure across the packer 66 prior to unsetting. The upwardly directed force also displaces the outer sleeve 108 upward, so that the expandable ring 106 of the flow restrictor 72 can retract inward.

In step 174, the closure member 136 is displaced to its closed position as the BHA 44 displaces upwardly through the open downhole valve 40*a*. The keys 74 engage the profile 136*b* in the closure member 136, so that the closure member displaces upward with the shifting tool 48 as the BHA displaces upward through the downhole valve 40*a* (see FIGS. 19 & 20).

In step 176, the BHA 44 is positioned for operating the next downhole valve 40*b* in order to fracture the next zone 36*c*. In this example, the BHA 44 is positioned above the downhole valve 40*b* (longitudinally between the downhole valves 40*b,c*, as depicted in FIG. 21).

Steps 162-176 can be repeated for each of the downhole valves 40*a-e* in succession to fracture each of the corresponding zones 36*b-f*. However, note that it is not necessary for the downhole valves 40*a-e* to be operated between open and closed configurations in any particular order to fracture the corresponding zones 36*b-f* in any particular order. In addition, any number of downhole valves may be operated, and any number of zones may be fractured or otherwise treated, in keeping with the scope of this disclosure.

Although a fracturing operation for each of the zones 36*a-f* is described above, it is not necessary in keeping with the scope of this disclosure for any zone or combination of zones to be fractured. Other operations may be performed (such as, conformance, injection, water or steam flooding, production, etc.) in other examples.

It may now be fully appreciated that the above disclosure provides significant advancements to the art of designing, constructing and utilizing well systems, bottomhole assemblies, shifting tools and associated methods for operating downhole valves. In examples described above, the downhole valves 40*a-e* can be conveniently and reliably operated to allow for selective fracturing of the zones 36*b-f*. Fluid flow can be used in some examples to produce a pressure differential across an extendable flow restrictor 72 of a shifting tool 48 to assist in displacing the closure member 136 of a downhole valve 40*a-e*. The downhole valves 40*a-e* can be closed by the shifting tool 48 after the respective fracturing operations, so that the fractured zones 36*b-f* can "heal" prior to production operations.

The above disclosure provides to the art a shifting tool 48 for use in a subterranean well. In one example, the shifting tool 48 can include a flow restrictor 72 outwardly extendable in the well from a radially retracted position to a radially extended position.

The flow restrictor 72 may comprise a resilient ring 106 that is radially outwardly extendable in response to longitudinal displacement of a sleeve 108 relative to the resilient ring 106.

The flow restrictor 72 may be outwardly extendable in response to compression of the shifting tool 48. The flow restrictor 72 may be outwardly extendable in response to a longitudinal force applied to the shifting tool 48. The flow restrictor 72 may be inwardly retractable in response to a longitudinal force applied to the shifting tool 48.

The shifting tool 48 may also include at least one outwardly extendable key 74 configured to engage a downhole profile 136*a,b*, a retainer 114 that retains the key 74 in an inwardly retracted position, and a piston 116*a* displaceable in response to a pressure differential between an exterior and an interior of the shifting tool 48. The key 74 is permitted to extend outward in response to displacement of the piston 116*a*. The pressure differential may comprise a pressure on the interior of the shifting tool 48 being greater than a pressure on the exterior of the shifting tool 48.

The shifting tool 48 may include a valve 76 that selectively prevents and permits fluid communication between the exterior and the interior of the shifting tool 48. The retainer 114, the piston 116*a* and a closure member 136 of the valve 76 may be formed on a sleeve 116 that is longitudinally displaceable relative to a generally tubular inner mandrel 118 of the shifting tool 48.

A closure member 116*b* of the valve 76 may be displaceable with the piston 116*a*.

The shifting tool 76 can comprise a ratchet device 122 that permits displacement of a closure member 116*b* of the valve 76 to an open position, but prevents displacement of the closure member 116*b* from the open position to a closed position.

The above disclosure also provides to the art a method 150 of operating at least one downhole valve 40*a-e* connected in a tubular string 34 in a subterranean well. In one example, the method 150 can include the steps of flowing a fluid 142 through a flow restriction 28*a* (such as, in the annulus 28 between the BHA 44 and the tubular string 34), thereby creating a pressure differential across the flow restriction 28*a*; and shifting a closure member 136 of the downhole valve 40*a-e* between open and closed positions, in response to the pressure differential, while the fluid 142 flows through the flow restriction 28*a*.

The method 150 can include forming the flow restriction 28*a* radially between a shifting tool 48 and the downhole valve 40*a-e*.

The method 150 can include forming the flow restriction 28*a* radially between a shifting tool 48 and the closure member 136.

The method 150 can include engaging a shifting tool 48 with a profile 136*a,b* formed in the closure member 136.

The shifting tool 48 may be engaged with the closure member profile 136*a* while the fluid 142 flows through the flow restriction 28*a*.

The method 150 can include positioning a shifting tool 48 in the downhole valve 40*a-e*, and displacing a flow restrictor 72 radially outward from the shifting tool 48.

The flow restrictor 72 may displace radially outward in response to axial compression of the shifting tool 48 downhole. The flow restrictor 72 may displace radially inward in response to a longitudinal force applied to the shifting tool 48.

The flow restrictor 72 displacing step may include reducing an annular flow area between the shifting tool 48 and the downhole valve 40*a-e*.

The flow restrictor 72 may displace radially outward after the shifting tool 48 is engaged with the closure member 136.

The method 150 may include outwardly extending keys 74 from a shifting tool 48 downhole, in response to fluid pressure applied to the shifting tool 48, and then engaging the keys 74 with a profile 136*a,b* formed in the closure member 136.

The closure member 136 shifting step may include shifting the closure member 136 to the open position. The method 150 may further include subsequently shifting the closure member 136 to the closed position.

The above disclosure also describes a method 150 of operating at least one downhole valve 40*a-e* connected in a tubular string 34 in a subterranean well, in which the method 150 comprises the steps of positioning a shifting tool 48 in the tubular string 34; then outwardly extending keys 74 from the shifting tool 48, in response to fluid pressure applied to the shifting tool 48; then engaging the keys 74 with a profile 136*a,b* formed in a closure member 136 of the downhole valve 40*a-e*; and then shifting the closure member 136 between open and closed positions.

The fluid pressure may be applied to an annulus 28 formed between the shifting tool 48 and the downhole valve 40*a-e*.

The method 150 may include displacing a flow restrictor 72 radially outward from the shifting tool 48. The flow restrictor 72 may displace radially outward in response to axial compression of the shifting tool 48 downhole. The flow restrictor 72 may displace radially inward in response to a longitudinal force applied to the shifting tool 48.

The flow restrictor 72 displacing step may include reducing an annular flow area between the shifting tool 48 and the downhole valve 40*a-e*. The flow restrictor 72 may displace radially outward after the keys 74 are engaged with the closure member 136.

The closure member 136 shifting step may include flowing a fluid 142 through a flow restriction 28*a*, thereby creating a pressure differential across the flow restriction 28*a*. The closure member 136 may shift in response to the pressure differential, while the fluid 142 flows through the flow restriction 28*a*.

The method 150 may include forming the flow restriction 28*a* radially between the shifting tool 48 and the downhole valve 40*a-e*.

The method 150 may include forming the flow restriction 28*a* radially between the shifting tool 48 and the closure member 136.

The shifting tool 48 may be engaged with the closure member profile 136*a* while the fluid 142 flows through the flow restriction 28*a*.

Also described above is a shifting tool 48 that in one example includes at least one outwardly extendable key 74 configured to engage a downhole profile 136*a,b*; a retainer 114 that retains the key 74 in an inwardly retracted position; and a piston 116*a* displaceable in response to a pressure differential between an exterior and an interior of the shifting tool 48. The key 74 is permitted to extend outward in response to displacement of the piston 116*a*.

The pressure differential can comprise a pressure on the exterior of the shifting tool 48 being greater than a pressure on the interior of the shifting tool 48. In some examples, the pressure differential can comprise a pressure on the interior of the shifting tool 48 being greater than a pressure on the exterior of the shifting tool 48.

The shifting tool 48 can include a valve 76 that selectively prevents and permits fluid communication between the exterior and the interior of the shifting tool 48. The retainer 114, the piston 116*a* and a closure member 116*b* of the valve 76 may be formed on a sleeve 116 that is longitudinally displaceable relative to a generally tubular inner mandrel 118 of the shifting tool 48. In some examples, the retainer 114, the piston 116*a* and the closure member 116*b* may be formed on multiple or separate components.

A closure member 116*b* of the valve 76 may be displaceable with the piston 116*a*.

The shifting tool 48 may include a ratchet device 122 that permits displacement of a closure member 116*b* of the valve 76 to an open position, but prevents displacement of the closure member 116*b* from the open position to a closed position.

The shifting tool 48 may include an outwardly extendable flow restrictor 72. The flow restrictor 72 may be outwardly extendable in response to compression of the shifting tool 48, or in response to a longitudinal force applied to the shifting tool 48. The flow restrictor 72 may be inwardly retractable in response to a longitudinal force applied to the shifting tool 48.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of operating at least one downhole valve connected in a tubular string in a subterranean well, the method comprising:

radially outwardly expanding a flow restrictor in response to longitudinal compression of the flow restrictor, thereby forming an annular flow restriction without preventing flow between the flow restrictor and a closure member, in which the flow restrictor comprises at least one ring;

flowing a fluid through the flow restriction, thereby creating a pressure differential across the flow restriction; and the pressure differential producing a longitudinally directed force which acts to shift the closure member of the downhole valve between open and closed positions.

2. The method of claim 1, further comprising forming the flow restriction radially between a shifting tool and the downhole valve.

3. The method of claim 1, further comprising forming the flow restriction radially between a shifting tool and the closure member.

4. The method of claim 1, further comprising engaging a shifting tool with a profile formed in the closure member.

5. The method of claim 4, in which the shifting tool is engaged with the closure member profile while the fluid flows through the flow restriction.

6. The method of claim 1, further comprising positioning a shifting tool in the downhole valve, and displacing the flow restrictor radially outward from the shifting tool.

7. The method of claim 6, in which the flow restrictor displaces radially outward in response to axial compression of the shifting tool downhole.

8. The method of claim 6, in which the flow restrictor displacing comprises reducing an annular flow area between the shifting tool and the downhole valve.

9. The method of claim 6, in which the flow restrictor displaces radially outward after the shifting tool is engaged with the closure member.

10. The method of claim 6, further comprising displacing the flow restrictor radially inward after the flow restrictor is displaced radially outward.

11. The method of claim 1, further comprising outwardly extending keys from a shifting tool downhole, in response to fluid pressure applied to the shifting tool, and then engaging the keys with a profile formed in the closure member.

12. The method of claim 1, in which the closure member shifting comprises shifting the closure member to the open position, and in which the method further comprises then shifting the closure member to the closed position.

* * * * *